US011313380B2

(12) United States Patent
Azzouz et al.

(10) Patent No.: US 11,313,380 B2
(45) Date of Patent: Apr. 26, 2022

(54) MOTOR VEHICLE FAN

(71) Applicant: Valeo Systemes Thermiques, Le Mesnil Saint Denis (FR)

(72) Inventors: Kamel Azzouz, Le Mesnil Saint Denis (FR); Amrid Mammeri, Le Mesnil Saint Denis (FR); Farid Bakir, Le Mesnil Saint Denis (FR); Sofiane Khelladi, Le Mesnil Saint Denis (FR)

( * ) Notice: Subject to any disclaimer, the term of this patent is extended or adjusted under 35 U.S.C. 154(b) by 91 days.

(21) Appl. No.: 16/621,508

(22) PCT Filed: Jun. 12, 2018

(86) PCT No.: PCT/EP2018/065560
§ 371 (c)(1),
(2) Date: Jan. 9, 2020

(87) PCT Pub. No.: WO2018/229081
PCT Pub. Date: Dec. 20, 2018

(65) Prior Publication Data

US 2020/0232475 A1 Jul. 23, 2020

(30) Foreign Application Priority Data

Jun. 12, 2017 (FR) ..... 1755249
Jun. 12, 2017 (FR) ..... 1755252

(51) Int. Cl.
*F04D 29/32* (2006.01)
*F04D 19/00* (2006.01)
(Continued)

(52) U.S. Cl.
CPC ..... *F04D 29/325* (2013.01); *F01P 5/04* (2013.01); *F01P 11/10* (2013.01); *F04D 19/002* (2013.01);
(Continued)

(58) Field of Classification Search
CPC ..... F05D 2220/36; F05D 2240/307; F04D 29/324; F04D 29/325; F04D 29/526;
(Continued)

(56) References Cited

U.S. PATENT DOCUMENTS 4,962,734 A 10/1990 Jorgensen
5,221,187 A * 6/1993 Lorea ..... F04D 29/386 416/189
(Continued)

FOREIGN PATENT DOCUMENTS

DE 102010043988 A1 5/2012
JP H9126199 A 5/1997
JP H9158893 A 6/1997

OTHER PUBLICATIONS

International Search Report and Written Opinion corresponding to International Application No. PCT/EP2018/065560, dated Jul. 4, 2018 (13 pages).

*Primary Examiner* — Long T Tran
(74) *Attorney, Agent, or Firm* — Osha Bergman Watanabe & Burton LLP

(57) ABSTRACT

The invention concerns an impeller (1*a*, 1*b*, 1*c*, 1*d*, 1*e*, 1*f*) of a motor vehicle fan comprising:

a cylindrical ring (2) having a center (P), blades (3) extending from the cylindrical ring (2) and toward the center (P), each blade (3) having two radially opposite ends (4, 5), referred to as the blade root end (4) and the blade tip end (5), the blade root end (4) being directed toward the center (P) and the blade tip end (5) being secured to the cylindrical ring (2), characterized in that all the blade root ends (4) are free or linked together by a central hub (20) of reduced diameter.

19 Claims, 26 Drawing Sheets

(51) Int. Cl.

| | |
|---|---|
| ***F01D 19/00*** | (2006.01) |
| ***F01D 25/12*** | (2006.01) |
| ***F01P 5/04*** | (2006.01) |
| ***F01P 11/10*** | (2006.01) |
| ***F04D 25/06*** | (2006.01) |

(52) U.S. Cl.
CPC ..... *F04D 25/06* (2013.01); *F01P 2005/046* (2013.01); *F05B 2240/33* (2013.01)

(58) Field of Classification Search
CPC .... F04D 29/181; F04D 17/025; F04D 19/002; F01D 17/162; F01D 25/12
See application file for complete search history.

(56) References Cited

U.S. PATENT DOCUMENTS

| | | | | |
|---|---|---|---|---|
| 2006/0051202 | A1* | 3/2006 | Patti | F04D 29/282 415/204 |
| 2010/0143164 | A1 | 6/2010 | Yan et al. | |
| 2013/0323072 | A1* | 12/2013 | Aschermann | F04D 25/022 416/234 |
| 2016/0138614 | A1* | 5/2016 | Fuchibe | F04D 29/282 416/144 |

* cited by examiner

MOTOR VEHICLE FAN

The invention concerns all the fans of a motor vehicle and more particularly the impellers of those fans. Fans participate, for example, in equipping electric motors, motor-fan units or again assemblies intended for ventilation and air conditioning the passenger compartment. The invention finds a particularly advantageous application in the context of a motor-fan unit.

These fans are generally disposed under the hood and agitate a fluid, such as air. Taking the motor-fan unit as an example, the latter is situated at the front of the vehicle and cooperates with a heat exchanger also referred to as a radiator. To be more precise the motor-fan unit is situated on the radiator so as to force a flow of air through it, which makes it possible to cool the cooling liquid circulating between the radiator and the engine. Thus the motor-fan unit provides an efficacious flow of air to optimize the exchange of heat with the radiator. In other words, the motor-fan unit makes it possible to facilitate and to sustain the management of the temperature of the engine.

To this end the motor-fan unit comprises a support for securing the motor-fan unit to the vehicle and on which is mounted a fan including an impeller and a means of driving the impeller, such as an electric motor. To this end the impeller comprises a central hub housing the electric motor at the center of the impeller, which generates a dead zone in the sense that not all of the area of the impeller is used to agitate the air. The presence of this dead zone causes a loss of performance of the motor-fan unit. Moreover, this dead zone at the level of the central hub generates unwanted turbulence at the blade roots of the impeller.

Moreover, the performance of the motor-fan unit is also linked to the dimensions and to the design of the impeller. If the impeller is too large, that can lead to excess consumption of electrical energy. If the impeller is too small, its performance is inadequate, which leads to a risk of the engine overheating or of a malfunction of the air conditioner. A badly designed impeller can also generate noise and vibrations that can lead to a fault.

Also, the design of new vehicles, with ever smaller front grilles and less space under the hood, causes problems at the level of integrating the fans and sizing the impellers.

In this context, the invention aims to propose a solution such that the impeller of the fan is able to produce sufficient agitation of fluid, such as a flow of air, to prevent the risk of overheating of the internal combustion engine or electric motor of the motor vehicle and/or a malfunction of the air conditioner.

To this end, in accordance with a first embodiment, the invention proposes an impeller of a motor vehicle fan comprising: a cylindrical ring having a center, blades extending from the cylindrical ring and toward the center, each blade having two radially opposite ends, referred to as the blade root end and the blade tip end, the blade root end being directed toward the center and the blade tip end being secured to the cylindrical ring, characterized in that all the blade root ends are free ends.

In other words, it is understood that the impeller does not include a central hub securing the blades around the center of the impeller. The absence of any such hub enables improvement of the performance of the impeller. In fact, eliminating the hub also eliminates the dead zone situated along the rotation axis which makes it possible to use all of the volume of the impeller and to increase the volume of fluid agitated by the impeller.

Moreover, by providing an impeller offering better performance, it becomes possible to circumvent impeller sizing problems.

According to one or more optional features that may be adopted separately or in combination:

- The impeller comprises a free central zone forming an imaginary circle having a diameter less than or equal to 15% of a diameter of the impeller. A ratio of this kind makes it possible to ensure that the free central zone defined around the center of the impeller is not too large and that the air is agitated across this free central zone.
- The diameter of the impeller corresponds to an inside diameter of the cylindrical ring. In fact, that inside diameter is linked to the available agitation area of the impeller. Depending on the application of the impeller, this inside diameter is between 25 and 40 centimeters inclusive.
- Each blade has an NACA 65(24)10 aerodynamic profile. NACA profiles correspond to aerodynamic profiles designed for the wings of aircraft developed by the Comité consultatif national pour l'aéronautique (NACA). The shape of NACA profiles is described by a series of digits that follow the abbreviation "NACA". The parameters in the numerical code may be entered into the equations to generate accurately the section of a blade and to calculate its properties. For the NACA 65(24)10 aerodynamic profile the 6 refers to series 6, the 5 corresponds to the position relative to the chord of the minimum pressure at the extrados (i.e. 50% of the chord, at which location there is generally also the maximum thickness), 24 corresponds to the lift coefficient at zero incidence, i.e. the aerodynamic camber coefficient (multiplied by 10), denoted $Cz\infty 0$ and finally 10 corresponds to the maximum thickness relative to the chord (as a percentage).
- The blades are symmetrically distributed on the impeller. This means that the distance separating the same point on a plurality of blades is constant.
- The impeller comprises at least six blades. This number of a blades enables transfer of more power to the fluid agitated by the impeller, here air.
- The blades equipping the impeller are all identical.
- Each blade has a chord increasing regularly from the blade root end to the blade tip end. The chord corresponds to the straight line segment connecting the leading edge and the trailing edge in a cross section of the blade. Thus in any section of the blade from the blade root end to the blade tip end it can be seen that the chord increases in a uniform and regular manner.
- The blade root end has a chord less than a chord of the blade tip end. It is then clear that the blade root end is smaller than the blade tip end.
- The blade root end has a non-zero chord. This ensures that the blade root end is not pointed.
- The blade root end has a chord forming an angle of 0 to 80 degrees with the rotation axis of the impeller. In other words, the pitch angle of the blade root end is between 0 and 80 degrees inclusive. When the blade root end has a chord coinciding with the rotation axis of the impeller the pitch angle is zero for the blade root end.
- The blade tip end has a chord forming an angle of 40 to 90 degrees with the rotation axis of the impeller. In other words, the pitch angle of the blade tip end is between 40 and 90 degrees inclusive. When the blade root end has a chord perpendicular to the rotation axis of the impeller the blade root end is not inclined on the cylindrical ring.

The cylindrical ring has a width, measured along a rotation axis of the impeller, such that the blades are entirely contained within a volume delimited by the cylindrical ring. It is then clear that the blades do not project beyond the ring, in particular in a direction parallel to the rotation axis of the impeller.

The blades have a twisted profile from the blade tip end toward the blade root end, the twist being defined about a torsion axis.

The torsion axis about which the blades have a twisted profile coincides with a radius of the impeller.

Along a blade, the ratio, referred to as the shrinkage allowance, between a chord of a blade and a distance separating the same point on two adjacent blades decreases toward the blade root end.

The impeller comprises at least one electromagnetic element intended to participate in driving the impeller in rotation.

The at least one electromagnetic element is situated on the cylindrical ring of the impeller.

The impeller is configured to cooperate with a belt intended to participate in driving the impeller in rotation. To be more precise, the cylindrical ring is configured to receive a belt. To this end the cylindrical ring of the impeller comprises one or more grooves or one or more shoulders enabling the belt to be held in place on the ring without this generating movement of the impeller relative to its rotation axis.

The impeller is configured to cooperate with at least one gear intended to participate in driving the impeller in rotation. To be more precise, the cylindrical ring is configured to cooperate with at least one of the gears. To this end the cylindrical ring of the impeller is intended to receive a toothed rim in order to be able to drive the impeller in rotation via the at least one gear. In accordance with a variant embodiment, the cylindrical ring of the impeller is toothed so that it can be driven in rotation by the at least one gear.

In accordance with a second embodiment the invention further proposes an impeller of a motor vehicle fan, comprising:

a cylindrical ring having a diameter, a central hub inscribed in the cylindrical ring having a diameter less than the diameter de the cylindrical ring, the central hub and the cylindrical ring being concentric, blades extending between the cylindrical ring and the central hub, characterized in that the diameter of the central hub is less than or equal to 15% of the diameter of the cylindrical ring.

In other words, it is understood that the impeller has a central hub of small size relative to the size of the impeller. A central hub of this kind, which is smaller compared to the prior art, has the single role of maintaining the impeller on its rotation axis and is not intended either to support or to house a motor for driving the impeller in rotation. A motor of this kind for driving the impeller is necessary but would be situated at the periphery of the impeller. Thus by reducing the size of the central hub the agitation area of the impeller available for agitation the fluid is increased compared to the prior art. The performance of the impeller is then improved.

As a result it is not necessary to increase the outside diameter of the impeller to increase the quantity of air agitated by the impeller. This avoids the problems of congestion under the hood because, for the same dimension, the impeller according to the invention offers improved performance.

The hub is defined as being the central part on which are assembled the parts such as the blades that have to turn about an axis.

Moreover, it is to be noted that where the measurement of the diameters of the ring or of the hub are concerned it is preferable to take dimensions representative of the agitation area of the impeller. To this end the inside diameter of the cylindrical ring and the outside diameter of the central hub are taken into consideration. The inside and outside diameters are to be understood according to their position relative to the center of the element concerned.

In accordance with one or more optional features that may be adopted separately or in combination:

Each blade has two radially opposite ends, referred to as the blade root end and the blade tip end, the blade root end being secured to the central hub and the blade tip end being secured to the cylindrical ring.

The central hub takes the form of a ring in which a zone is left free so as to form a passage allowing a fluid to pass through the central hub. In this case the central hub has the single role of securing the blades of the impeller to one another.

The diameter of the cylindrical ring is less than or equal to 43 centimeters. This dimension of the impeller is particularly suitable for application to a motor-fan unit fan.

The diameter of the central hub is between 3 and 4 centimeters inclusive. To be more precise, the measurement is taken at the level of the outside diameter of the central hub.

The central hub is intended to receive a pin about which the impeller is free to rotate.

The central hub is intended to receive at least one rotation bearing providing a connection between the central hub and the pin. The presence of a rotation bearing allows the impeller to be mobile in rotation relative to the pin secured to a support unless the rotation bearing is a tight fit.

The central hub comprises at least one counterbore intended to receive the rotation bearing. The counterbore is concentric with the central hub.

The central hub is intended to be constrained to rotate with a shaft intended to participate in driving of the impeller in rotation.

The cylindrical ring has a width measured along a rotation axis of the impeller such that the blades are entirely contained within a volume delimited by the cylindrical ring. It is then clear that the blades do not project beyond the ring, in particular in a direction parallel to the rotation axis of the impeller.

The central hub is the same width as the cylindrical ring.

The blades have a twisted profile from the blade tip end to the blade root end, the twist being defined about a torsion axis.

The torsion axis about which the blades have a twisted profile coincides with a radius of the impeller.

Each blade has a chord increasing regularly from the blade root end to the blade tip end. The chord corresponds to the straight line segment connecting the leading edge and the trailing edge in a cross section of the blade. Thus in each section of the blade from the blade root end to the blade tip end it can be seen that the chord increases in a uniform and regular manner.

Along a blade, the ratio, referred to as the shrinkage allowance, between a chord of a blade and a distance separating the same point on two adjacent blades decreases toward the blade root end of a blade.

Each blade has an NACA 65(24)10 aerodynamic profile. NACA profiles correspond to aerodynamic profiles designed for the wings of aircraft developed by the Comité consultatif national pour l'aéronautique (NACA). The shape of NACA profiles is described by a series of digits that follow the abbreviation "NACA". The parameters in the numerical code may be entered into equations to generate accurately the section of a blade and to calculate its properties. For the NACA 65(24)10 aerodynamic profile the 6 refers to series 6, the 5 corresponds to the position relative to the chord of the minimum pressure at the extrados (i.e. 50% of the chord, at which location there is generally also the maximum thickness), 24 corresponds to the lift coefficient at zero incidence, i.e. the aerodynamic camber coefficient (multiplied by 10), denoted $Cz\infty 0$ and finally 10 corresponds to the maximum thickness relative to the chord (as a percentage).

The blades are symmetrically distributed on the impeller. This means that the distance separating the same point on a plurality of blades is constant.

The impeller comprises at least six blades. This number of a blades enables transfer of more power to the fluid agitated by the impeller, here air.

The blades equipping the impeller are all identical.

The blade root end has a chord less than a chord of the blade tip end. It is then clear that the blade root end is smaller than the blade tip end.

The blade root end has a non-zero chord. This ensures that the blade root end is not pointed.

The blade root end has a chord forming an angle of 0 to 80 degrees with the rotation axis of the impeller. In other words, the pitch angle of the blade root end is between 0 and 80 degrees inclusive. When the blade root end has a chord coinciding with the rotation axis of the impeller, that means that the pitch angle is zero for the blade root end.

The blade tip end has a chord forming an angle of 40 to 90 degrees with the rotation axis of the impeller. In other words, the pitch angle of the blade tip end is between 40 and 90 degrees inclusive. When the blade root end has a chord perpendicular to the rotation axis of the impeller the blade root end is not inclined on the cylindrical ring.

The impeller comprises at least one electromagnetic element intended to participate in driving the impeller in rotation.

The at least one electromagnetic element is situated on the cylindrical ring of the impeller.

The impeller is configured to cooperate with a belt intended to participate in driving the impeller in rotation. To be more precise, the cylindrical ring is configured to receive the belt. To this end the cylindrical ring of the impeller comprises one or more grooves or one or more shoulders enabling the belt to be held in place on the ring without this generating movement of the impeller relative to its rotation axis.

The impeller is configured to cooperate with at least one gear intended to participate in driving the impeller in rotation. To be more precise, the cylindrical ring is configured to cooperate with at least one of the gears. To this end the cylindrical ring of the impeller is intended to receive a toothed rim in order to be able to drive the impeller in rotation via the at least one gear. In accordance with a variant embodiment, the cylindrical ring of the impeller is toothed so that it can be driven in rotation by the at least one gear.

The impeller is of axial type. This means that it stirs a flow of air in a direction colinear with the direction from which the flow of air is aspirated.

The invention also has for subject matter a motor vehicle motor-fan unit comprising a support on which is mounted a fan, the fan comprising an impeller and a device for driving the impeller in rotation, characterized in that the impeller is as defined above. A motor-fan unit of this kind enables optimization of the agitation of a flow of air in the direction of a heat exchanger intended to regulate the temperature of the engine.

According to one embodiment, the rotation drive device is situated at the periphery of the impeller, on the support, and cooperates with the cylindrical ring of the impeller. This ensures that the drive device does not generate a dead zone in front of the impeller.

In accordance with one embodiment the impeller equipping the motor-fan unit has an outside diameter less than or equal to 40 centimeters. In accordance with an advantageous embodiment the impeller has a diameter equal to 40 cm to within the manufacturing tolerances.

Other features and advantages of the present invention will become more clearly apparent in the light of the description and the drawings, in which.

It should first of all be noted that the figures disclose the invention in detail for the requirements of executing the invention, said figures of course being usable to define the invention better if necessary. However, it is to be noted that these figures disclose only some of the possible embodiments of the invention.

In the following description reference will be made to an orientation as a function of an orthonormal system of axes O, x, y, z in which the impeller 1*a*, 1*b*, 1*c*, with its rotation axis RO coinciding with the axis Oz, is inscribed inside a cylindrical ring 2 having an inside radius RA.

Figure 1A:
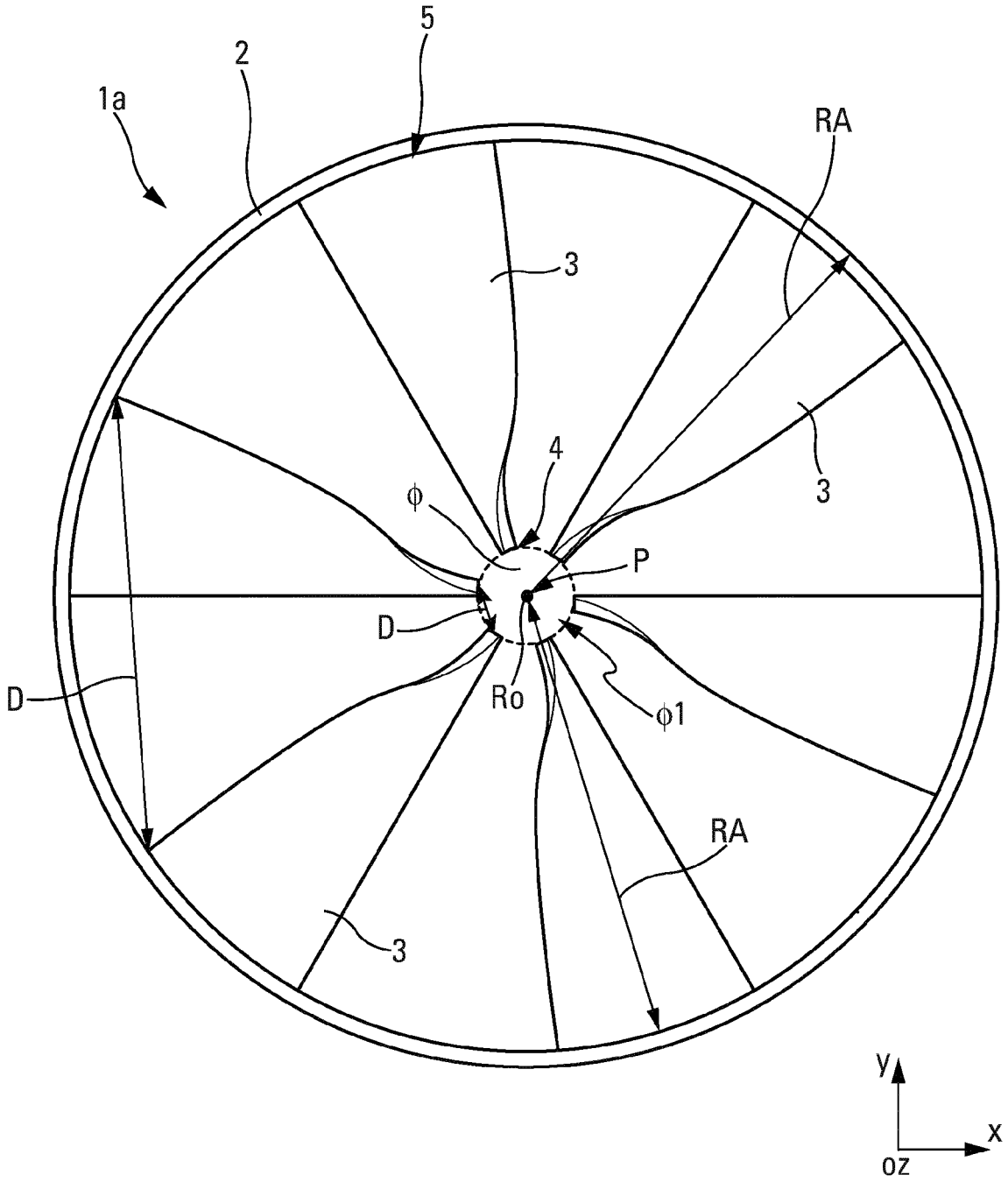
FIGS. 1A and 1B are respectively front and perspective views of a first embodiment of a motor vehicle fan impeller conforming to a first embodiment of the present invention, referred to as the first impeller and in which the free blade root ends are twisted to the maximum.

FIG. 1A shows the impeller 1*a*, also referred to as the first impeller 1*a*, of a motor vehicle fan comprising the cylindrical ring 2 having a center P, coinciding with that of the impeller 1*a*. The inside radius RA of the cylindrical ring 2 then coincides with the inside radius of the impeller 1*a*. The impeller 1*a* comprises blades 3 extending from the cylindrical ring 2 and in the direction of the center P. Each blade 3 has two radially opposite ends, referred to as a blade root end 4 and a blade tip end 5. By radially opposite is meant that along a radius RA of the impeller 1*a* or of the cylindrical ring 2 the blade tip end 5 is situated farthest from the center P while the foot root end 4 of the same blade 3 is situated nearest the center P. Moreover, the blade tip end 5 is secured to the cylindrical ring 2. To this end, the blades 3 and the cylindrical ring 2 are molded as one piece of material to form the impeller 1*a*.

It is to be noted that in the context of an application to a motor-fan unit the cylindrical ring 2 has an outside diameter between 38 and 42 centimeters inclusive and a width L between 2 and 5 centimeters inclusive, the width L being measured in a direction along the rotation axis RO of the impeller 1*a* (cf. FIG. 2). Moreover, in the context of an application to the field of motor vehicles the fluid agitated by the impeller 1*a* is air.

In order to maximize the usable area of the impeller 1*a* and to increase its performance the blade root ends 4, that is to say the ends directed toward the center P, are free ends. In other words, it is understood that the impeller 1*a* does not include a central hub securing the blades 3 around the center P of the impeller 1*a*. The absence of any such hub enables elimination of the dead zone situated along the rotation axis RO, which enables the volume of fluid agitated by the impeller to be increased and unwanted turbulence to be prevented.

More particularly, the fact that the blade root ends 4 are free ends makes it possible to define a free central zone around the center P of the impeller 1*a*. This free central zone takes the form of an imaginary circle ϕ, represented in dashed line in FIG. 1, having a diameter ϕ1. In accordance with an advantageous embodiment the blade root ends 4 are such that the diameter ϕ1 of the imaginary circle ϕ is less than 15% of the inside diameter of the impeller 1*a*. That ratio makes it possible to ensure that the free central zone around the center P of the impeller 1*a* is not too large and that air is agitated across this free central zone.

The impeller 1*a* comprises six blades 3; this number of blades 3 enables more power to be transferred to the fluid agitated by the impeller 1*a* and therefore the volume of fluid agitated by the impeller 1*a* to be increased. Of course, as a function of what is required, the number of blades 3 equipping the impeller 1*a* may be revised up or down. However, it is to be noted that in the context of an application to a motor-fan unit six blades 3 represents an optimum in terms of fluid agitation and for the sizing of the impeller 1*a*. It is to be noted that the impeller 1*a* is of axial type in the sense that it stirs a flow of air in a direction colinear with the direction in which the flow of air is aspirated.

The six blades 3 are preferably symmetrically distributed on the impeller 1*a*. By this is meant that the same points on the blades 3 are regularly spaced from one another by a distance D. The distance D is shorter at the level of the blade root ends 4 than at the level of the blade tip ends 5. In accordance with a variant embodiment the blades 3 are disposed asymmetrically to reduce or to prevent tonal noise; to this end the distance D is different from one blade 3 to another.

As can be seen better in FIGS. 1B to 1F, it can be seen that the blades 3 are entirely contained inside the cylindrical ring 2 and do not project beyond the cylindrical ring 2, in particular in a radial direction. Moreover, the width L of the cylindrical ring 2, measured along the rotation axis RO of the impeller 1*a*, is such that the blades 3 are entirely contained inside the interior volume delimited by the cylindrical ring 2. It is then clear that the blades 3 do not project beyond the cylindrical ring 2, in particular in a direction parallel to the rotation axis RO of the impeller 1*a*. According to the example shown, the cylindrical ring 2 has a width L of 4.5 centimeters.

Moreover, FIGS. 1B to 1F show that the blades 3 have a twisted profile from the blade tip end 4 to the blade root end 5, the twist being defined around a torsion axis T. In accordance with this embodiment, the torsion axis T about which the blades 3 are twisted coincides with a radius RA of the impeller 1*a* or of the cylindrical ring 2. By twisted is meant that each blade 3 has a profile that has undergone a deformation by a rotation about an axis, here the radial axis RA of the impeller 1*a*.

The impeller 1*a*, represented in FIGS. 1A to 1F has blade root ends 4 that have undergone greater torsion than the blade tip ends 5. In fact, as can be seen in the FIG. 1C section, the blade root end 4 has a chord C1 parallel to the rotation axis RO of the impeller 1*a*. The chord C of a blade 3 corresponds to the straight line segment connecting the leading edge 6 and the trailing edge 7 of the blade 3 in a cross section of the blade 3. The leading edge 6 of a blade 3 is the edge that splits the air when the impeller 1*a* is rotating; in other words the leading edge 6 corresponds to the first edge of the blade 3 in contact with the air and the trailing edge 7 corresponds to the final edge of the blade 3 that the air touches during rotation of the impeller 1*a*. Thus the angle that the chord C1 and the rotation axis RO of the impeller 1*a* form, also referred to as the pitch angle A, is zero; the twist is therefore maximum. Generally speaking, the blade root end 4 has a pitch angle A between 0 and 10 degrees inclusive. This pitch angle A is measured by its projection onto a median plane of the impeller 1*a* entirely containing the rotation axis RO.

Moreover, in accordance with this example as shown, the chord C1 of this blade root end 4 is equal to 2.5 centimeters. In the context of an application to a motor-fan unit, the chord C1 of the blade root end 4 is between 2 and 3 centimeters inclusive. The chord C1 of the blade root end 4 being non-zero, it is certain that this blade root end 4 is not pointed.

Figure 1B:
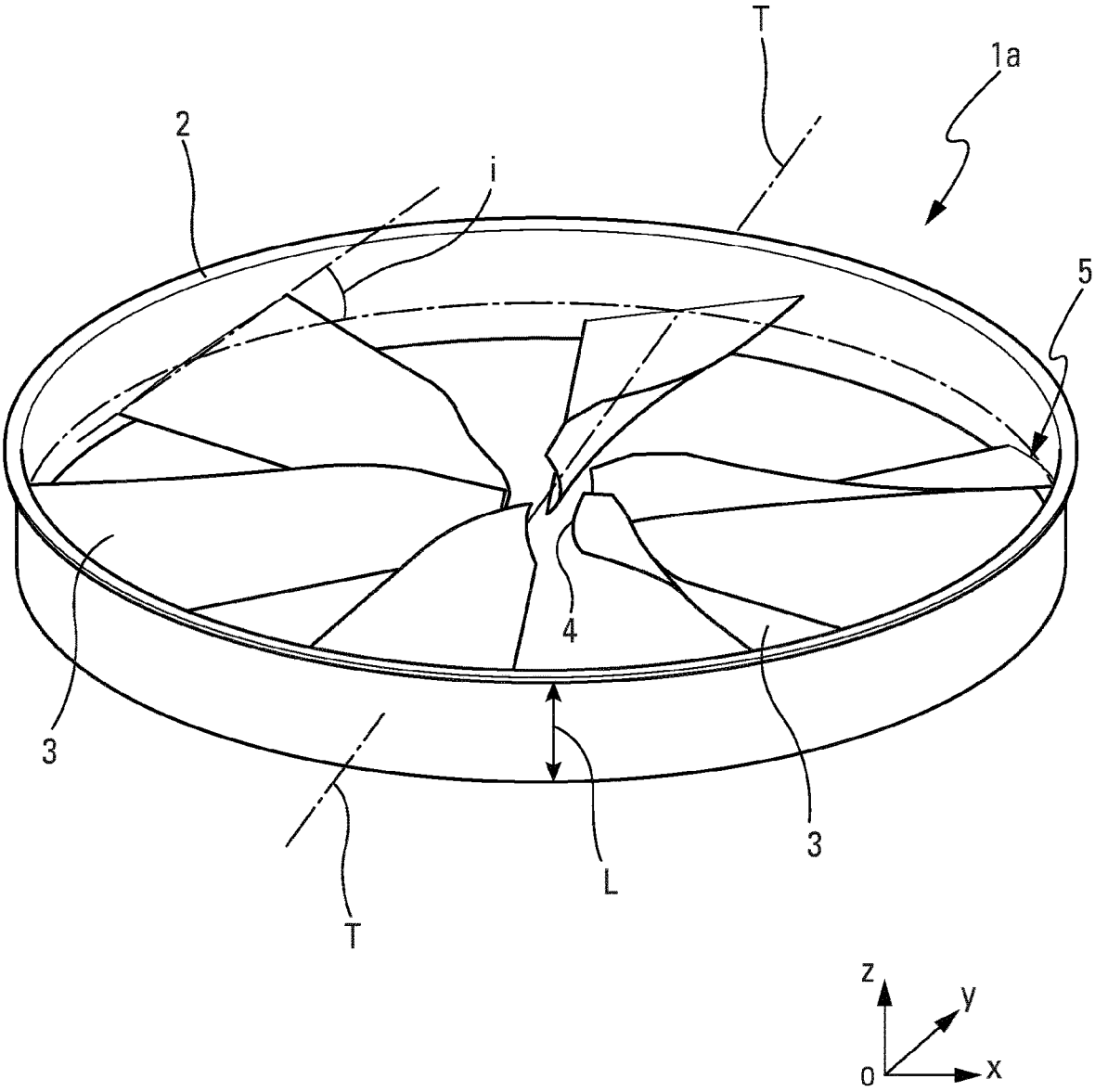
Figure 1C:
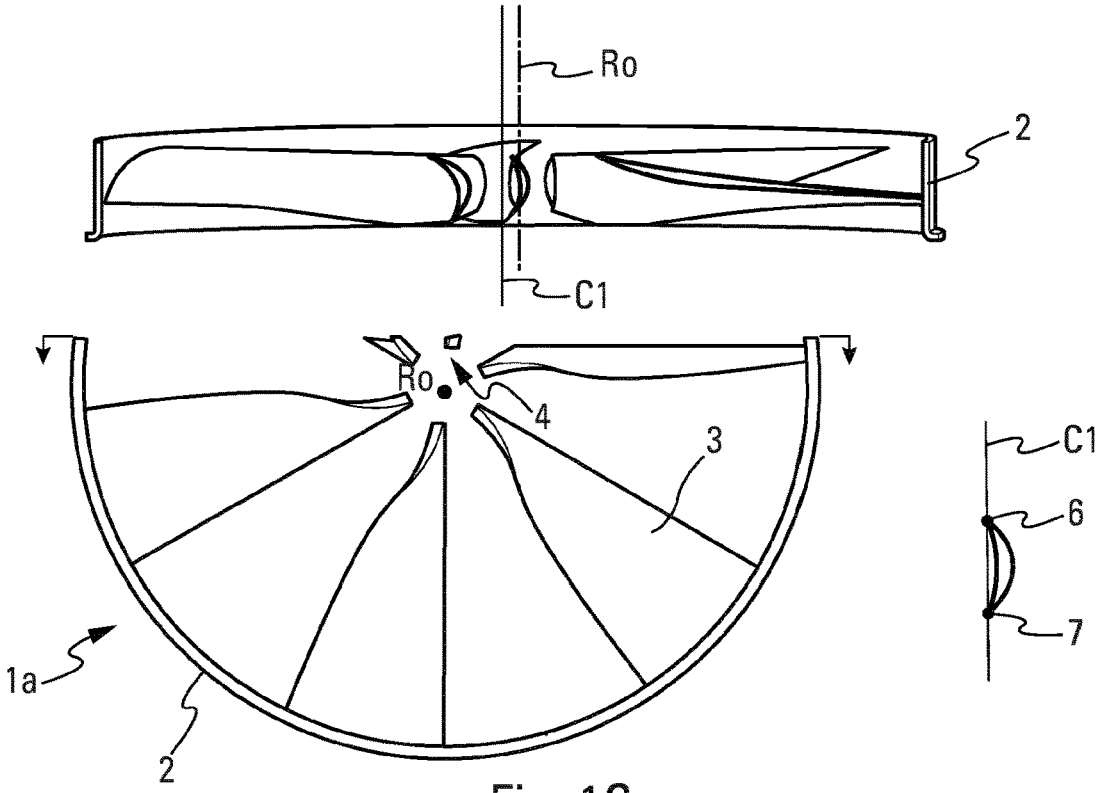
FIGS. 1C to 1E are views in section of the first impeller from different angles and at different blade heights.
Figure 1D:
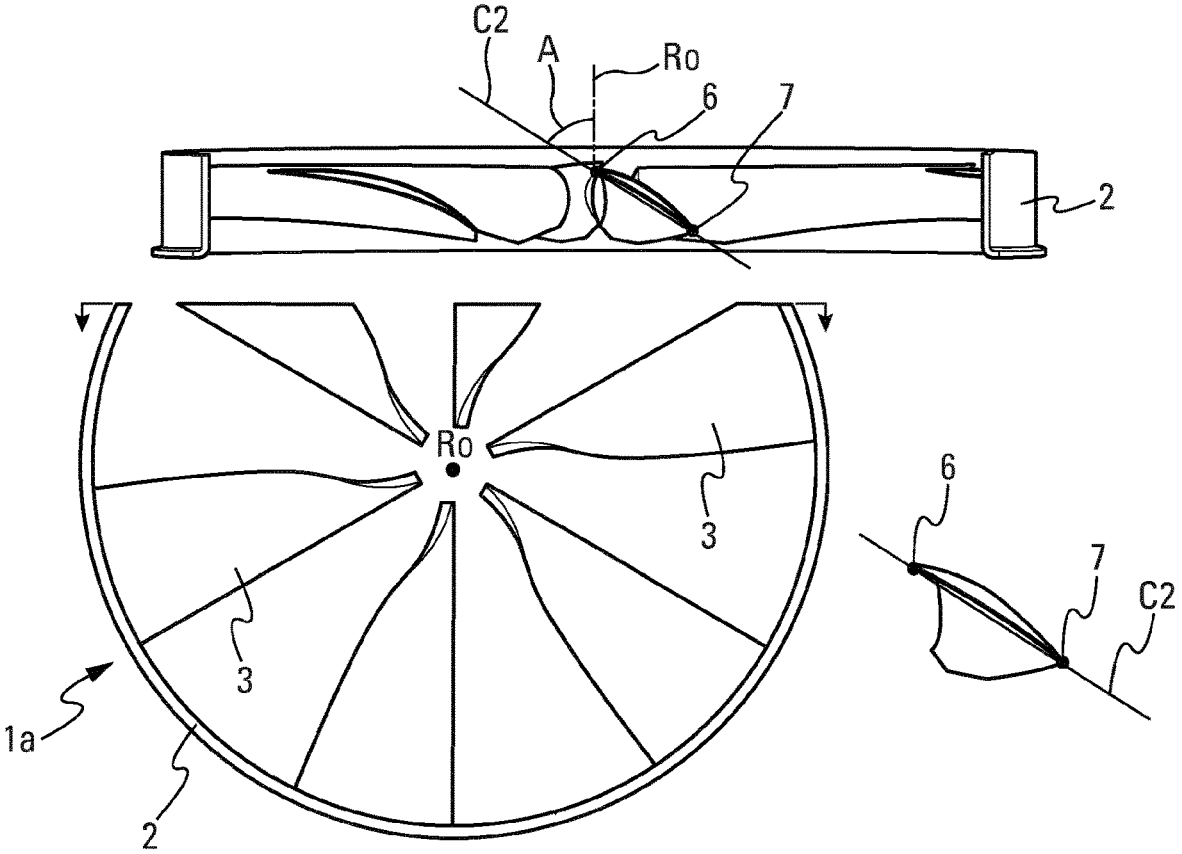

FIG. 1D shows a section of the blade 3 between the blade root end 4 and the blade tip end 5. It is then seen that the twist is open with respect to the FIG. 1C section. To be more precise, the section shown in FIG. 1D features a chord C2 forming a pitch angle A of 60 degrees with the rotation axis RO to within the manufacturing tolerances.

Figure 1E:
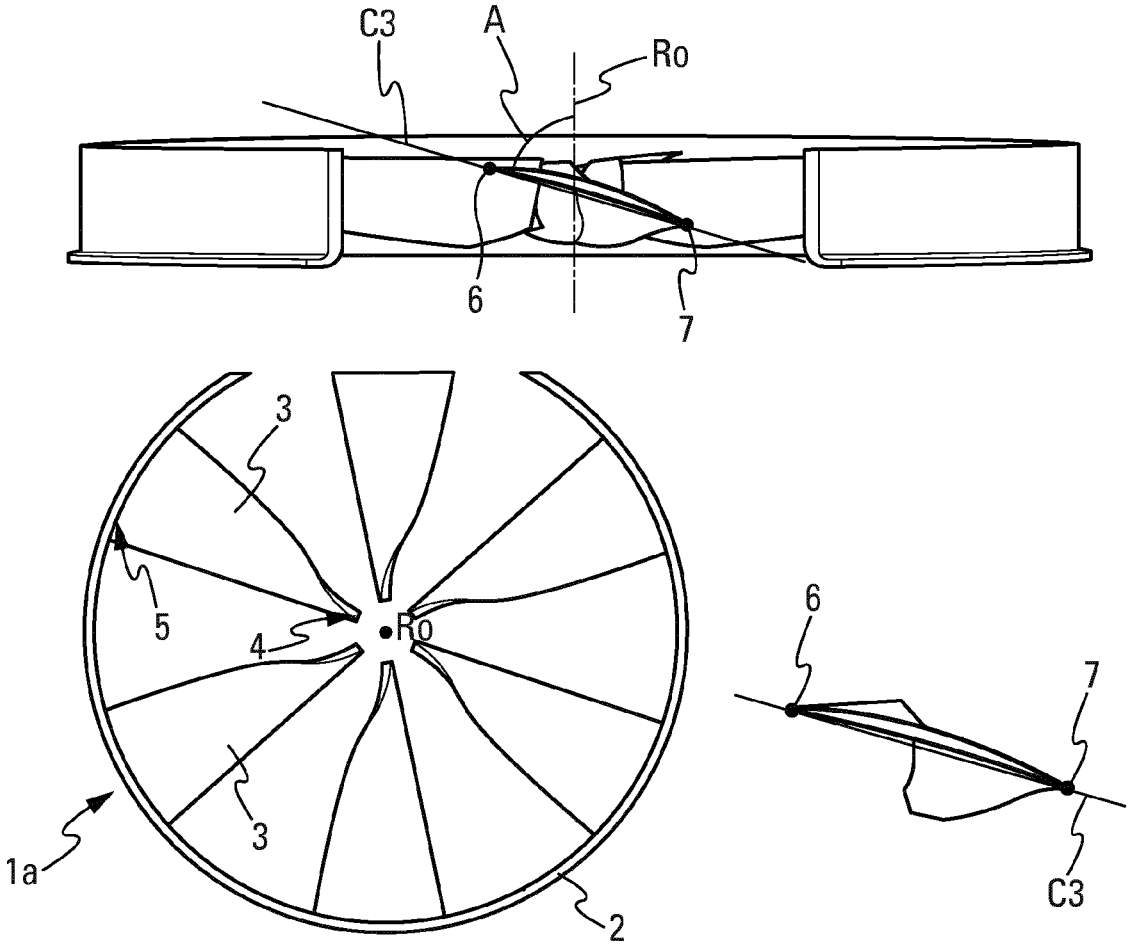

FIG. 1E then shows that the section of the blade tip end 5 has a chord C3 forming a pitch angle A of 75 degrees with the rotation axis RO to within the manufacturing tolerances. Generally speaking, the blade tip end 5 has a chord C3 forming a pitch angle between 40 and 80 degrees inclusive with the rotation axis RO of the impeller 1*a*. It is then clear that, the nearer the blade tip end 5, along a given blade 3, the more the pitch angle A increases and the twist decreases. When the blade root end 5 has a chord C3 perpendicular to the rotation axis RO of the impeller 1*a*, the blade tip end 5 is not inclined on the cylindrical ring 2. In fact, as can be seen in FIG. 1B the blade tip end 5 forms an angle of inclination 1 with the cylindrical ring 2, that angle 1 being the difference between 90 degrees and the pitch angle A, that is to say 90-75=25 degrees.

Moreover, the chord C3 of this blade tip end 5 is, in the example shown in FIG. 1E, equal to 8.5 centimeters. In the context of an application to a motor-fan unit the chord C3 of the blade tip end 5 is between 8 and 13 centimeters inclusive. It is then seen that the blade root end 4 has a chord C1 less than the chord C3 of the blade tip end 5. It is then clear that the blade root end 4 is smaller than the blade tip end 5.

Figure 1F:
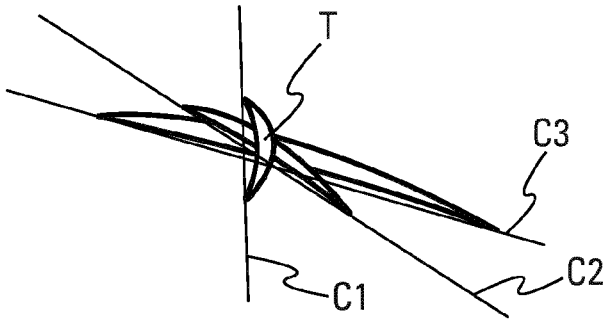
FIG. 1F represents a superimposition of three blade sections seen in FIGS. 1C to 1E.

FIG. 1F representing the various sections of FIGS. 1C to 1E superimposed on one another shows the evolution of the chord C1, C2, C3 along the blade 3 and about the torsion axis T. The pitch angle A along a blade 3 is therefore between 0 and 80 degrees inclusive to within the manufacturing tolerances.

It is to be noted that the blades 3 equipping the impeller are all identical to one another. To be more precise, each blade 3 has a NACA 65(24)10 aerodynamic profile. NACA profiles correspond to aerodynamic profiles designed for the wings of aircraft developed by the Comité consultatif national pour l'aéronautique (NACA). The shape of NACA profiles is described by a series of digits that follow the abbreviation "NACA". The parameters in the numerical code may be entered into equations to generate accurately the section of a blade and to calculate its properties. For the NACA 65(24)10 aerodynamic profile the 6 refers to series 6, the 5 corresponds to the position relative to the chord of the minimum pressure at the extrados, i.e. 50% of the chord, at which location there is generally also the maximum thickness, 24 corresponds to the lift coefficient at zero incidence, i.e. the aerodynamic camber coefficient multiplied by 10, denoted Cz∞0 and finally 10 corresponds to the maximum thickness relative to the chord as a percentage.

Figure 2A:
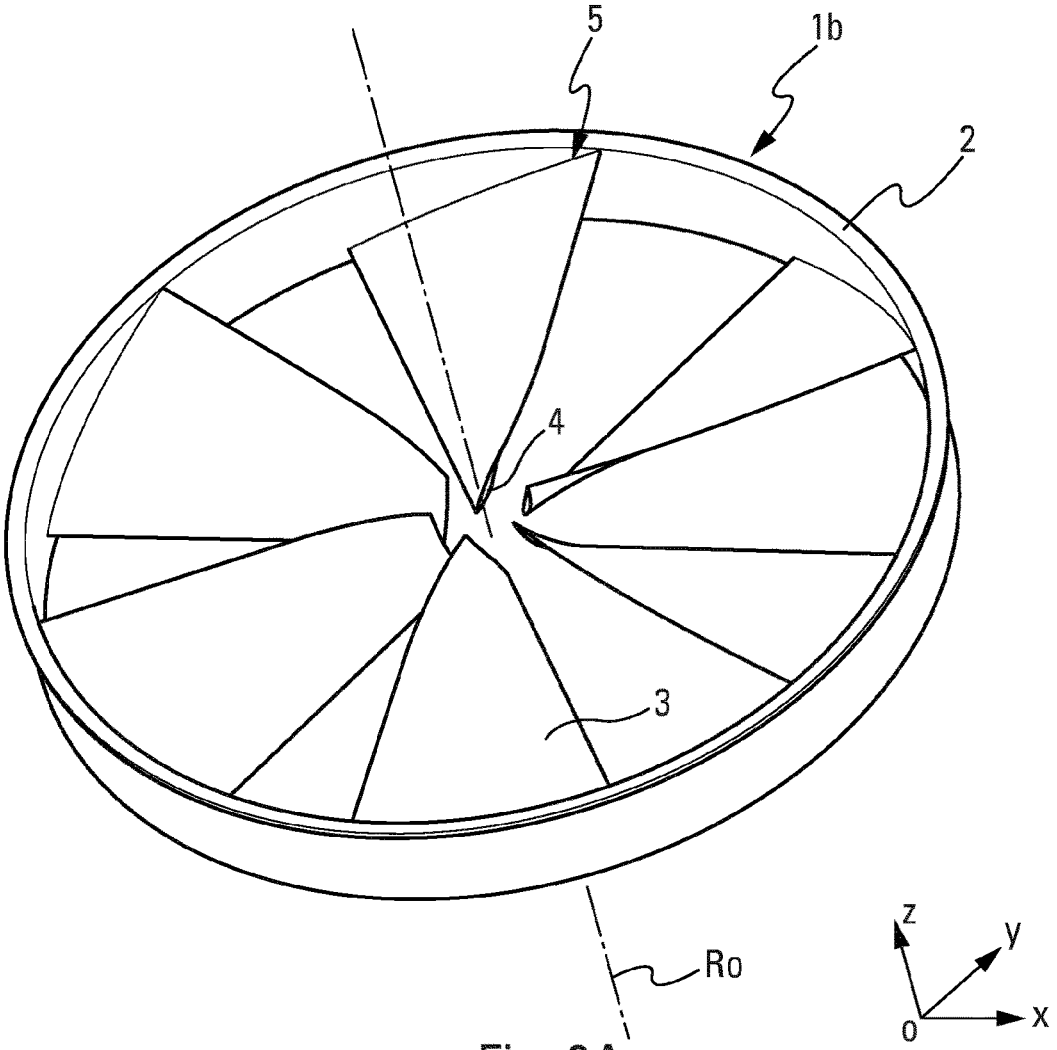
FIG. 2A is a perspective view of a second embodiment of a motor vehicle fan impeller conforming to the first embodiment of the present invention, referred to as the second impeller and in which the free blade root ends are less twisted than those of the blades of the first impeller.
Figure 2B:
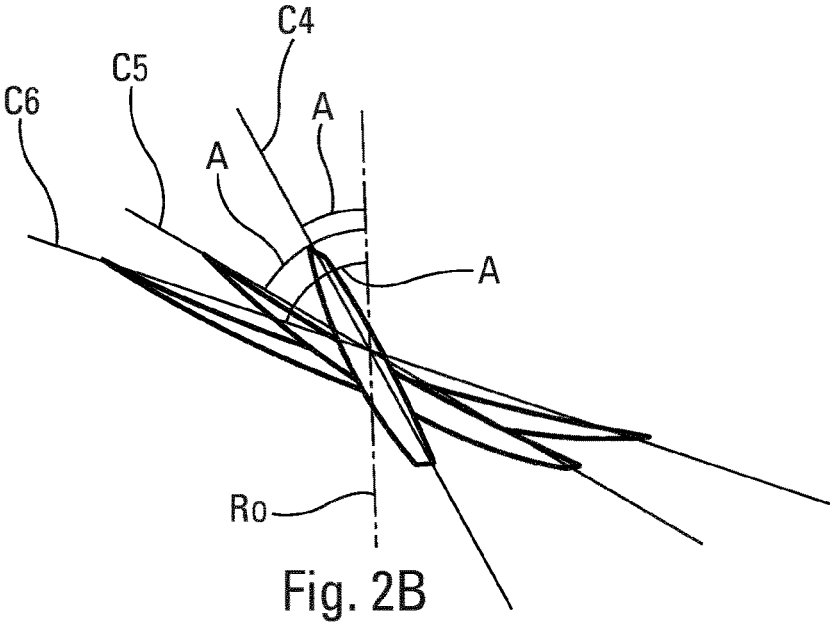
FIG. 2B represents a superimposition of three sections of one of the blades of the second impeller.

FIGS. 2A and 2B show a variant embodiment of the impeller 1*a* according to the invention, that will be referred to as the second impeller in the remainder of the description. This second impeller 1*b* has a free central zone, also includes six blades 3 inscribed in the cylindrical ring 2 that is in all respects identical to that of the first impeller 1*a* shown in FIGS. 1A to 1F. In other words, the blades 3 of this second impeller 1*b* also have blade root ends 4 that are free ends. Moreover, these blades 3 are all identical to one another and also follow an aerodynamic profile of NACA 65(24)10 type.

The only differences from the first impeller 1*a* lie in the dimensions of the blades 3 and the pitch angle A. As can be seen in FIG. 2B the superimposition of the three sections of a blade 3 of the second impeller 1*b* shows that the chord C4 of the blade root end 4 forms a pitch angle A of 30 degrees with the rotation axis RO of the impeller 1*b*, the chord C5 of the section between the two ends 4, 5 of the blades 3 forms a pitch angle A of 70 degrees with the rotation axis RO, and the chord C6 of the blade root end 4 forms a pitch angle A of 80 degrees with the rotation axis RO of the impeller 1*b*. Thus along a blade 3 the pitch angle A evolves from 30 degrees to 80 degrees. It is then clear that this second impeller 1*b* has blades 3 less twisted than the blades 3 of the first impeller 1*a*, the consequence of which is that the blade root ends 4 of the second impeller 1*b* are more loaded than the blade foot ends 4 of the first impeller 1*a*.

The dimensions of the chords are also different between the first and second impellers 1*a*, 1*b*. In accordance with the example shown the chord C4 of the blade foot end 4 is equal to 3 centimeters to within the manufacturing tolerances and the chord C6 of the blade tip end 5 is equal to twelve centimeters to within the manufacturing tolerances. Thus the chords C4, C6 of the ends 4, 5 of the blades 3 of the second impeller 1*b* are longer than the chords C1, C3 of the blade ends 4, 5 of the first impeller 1*a*.

For a better comparison of these two impellers 1*a*, 1*b* the graphs in FIGS. 3A to 3E represent the characteristics of the first impeller 1*a* while the graphs in FIGS. 4A to 4E represent the characteristics of the second impeller 1*b*. These figures show the evolution of certain geometrical characteristics of the impeller 1*a*, 1*b* as a function of the radius RA of the impeller 1*a*, 1*b* expressed in meters.

Figure 3A:
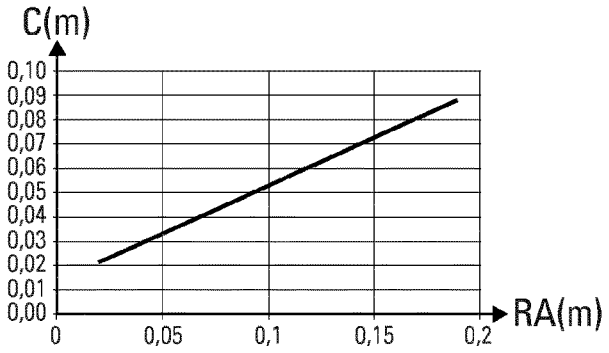
FIGS. 3A to 3E are graphs showing the evolution of certain geometrical characteristics of the first impeller as a function of the evolution of the radius of the impeller.
Figure 4A:
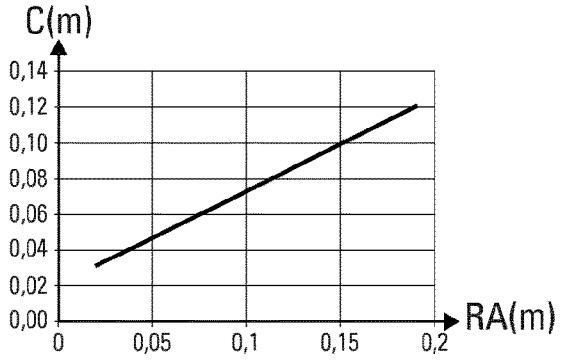
FIGS. 4A to 4E are graphs showing the evolution of certain geometrical characteristics of the second impeller as a function of the evolution of the radius of the impeller.

FIGS. 3A and 4A show that for a given blade 3, whether of the first or second impeller 1*a*, 1*b*, the chord C expressed in meters increases regularly from the blade root end 4 to the blade tip end 5. Thus in each section of the blade 3 from the blade root end 4 to the blade tip end 5 the chord C increases in a uniform and regular manner.

Figure 3B:
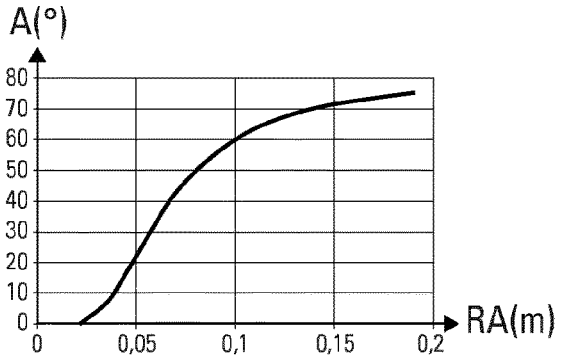
Figure 4B:
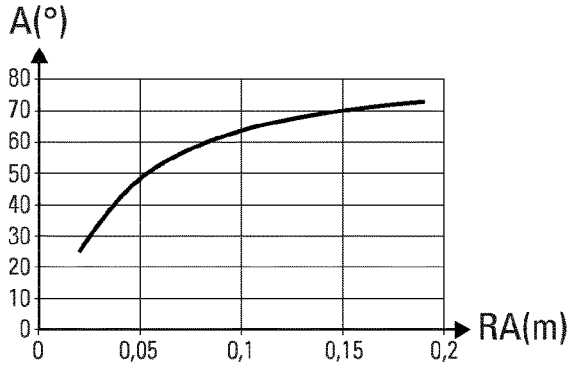

FIGS. 3B and 4B represent the evolution of the pitch angle A expressed in degrees over the first impeller 1*a* or over the second impeller 1*b* as a function of the radius RA of the given impeller 1*a*, 1*b*. In both cases it is seen that the pitch angle A increases on approaching the blade tip end 5 until a limit value between 70 and 80 degrees inclusive is reached. These graphs confirm that the twist of the first or second impeller 1*a*, 1*b* opens on approaching the blade tip end 5.

Figure 3C:
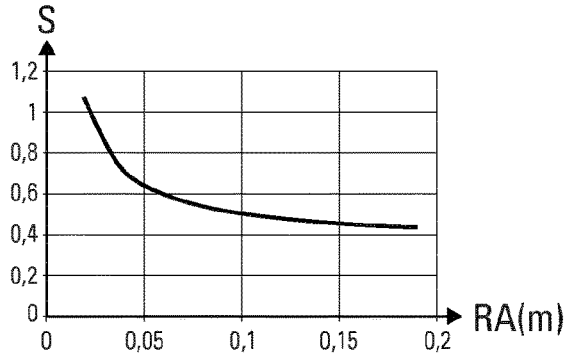
Figure 4C:
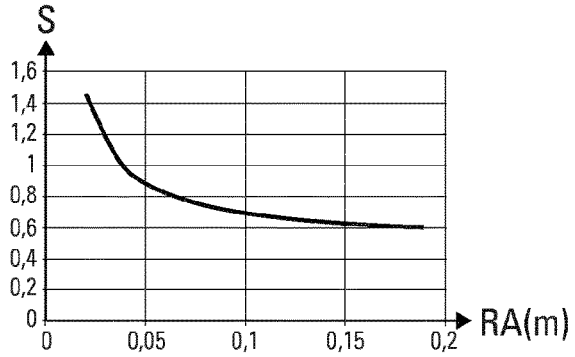

FIGS. 3C and 4C represent the evolution of the shrinkage allowance S, no units, of the first impeller 1*a* or the second impeller 1*b* as a function of the radius RA of the given impeller 1*a*, 1*b*. The shrinkage allowance S is defined for a given blade 3 section as being the ratio between the chord C and the distance D between two identical points on two adjacent blades 3. It is then seen that, for the two impellers 1*a*, 1*b*, the shrinkage allowance S decreases on approaching the blade tip end 5 until a limit value between 0.4 and 0.6 inclusive is reached for the first impeller 1*a* and between 0.6 and 0.8 inclusive is reached for the second impeller 1*b*.

Figure 3D:
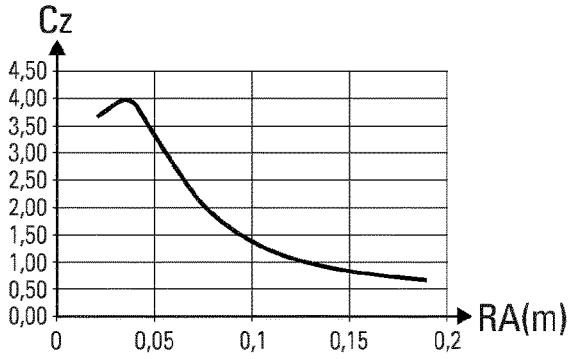
Figure 4D:
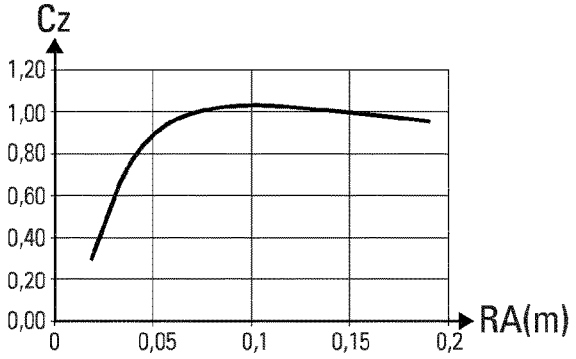

FIGS. 3D and 4D represent the evolution of the lift coefficient CZ, no units, of the first impeller 1*a* or of the second impeller 1*b* along the radius RA of the given impeller 1*a*, 1*b*. The lift coefficient represents the lift that is exerted perpendicularly to the blade 3. It is then seen that, for the first impeller 1*a*, the lift coefficient CZ decreases on approaching the blade tip end 5 until a limit value between 0.5 and 1 inclusive is reached while for the second impeller 1*b* the lift coefficient CZ increases on approaching the blade tip end 5 until a maximum value between 0.8 and 1 inclusive is achieved.

Figure 3E:
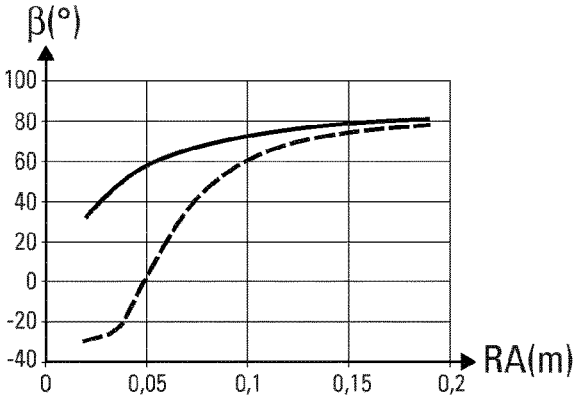
Figure 4E:
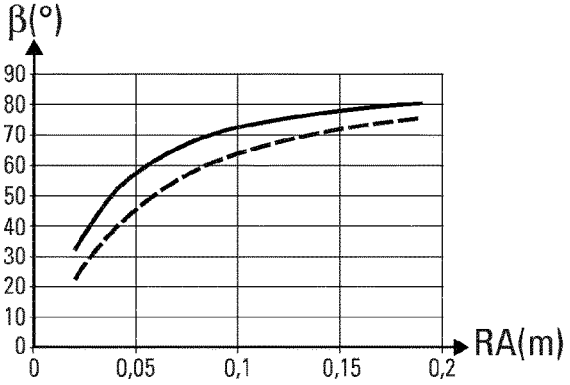

FIGS. 3E and 4E represent the evolution of the flow angle β expressed in degrees at the leading edge 6 (continuous line) or at the trailing edge 7 (dashed line) for a blade 3 of the first impeller 1*a* or of the second impeller 1*b* along the radius RA of the given impeller 1*a*, 1*b*. It is then seen that, for the first impeller 1*a*, more twisted than the second impeller 1*b*, the difference between the flow angle β of the leading edge 6 and the flow angle β of the trailing edge 7 is greater at the level of the blade root end 4 than at the blade tip end 5. For the second impeller 1*b* the difference between the flow angle β of the leading edge 6 and the flow angle β of the trailing edge 7 remains homogeneous all along the blade 3.

There will now be described with reference to FIGS. 5 to 7 the application of an impeller 1*c* according to the invention in a motor-fan unit 10. It has to be remembered that the motor-fan unit 10 makes it possible to optimize the agitation of a flow of air in the direction of a heat exchanger intended to regulate the temperature of an engine. In accordance with the invention, the first impeller 1*a*, just like the second impeller 1*b*, is particularly suitable for mounting in a motor-fan unit 10 of this kind.

Figure 5:
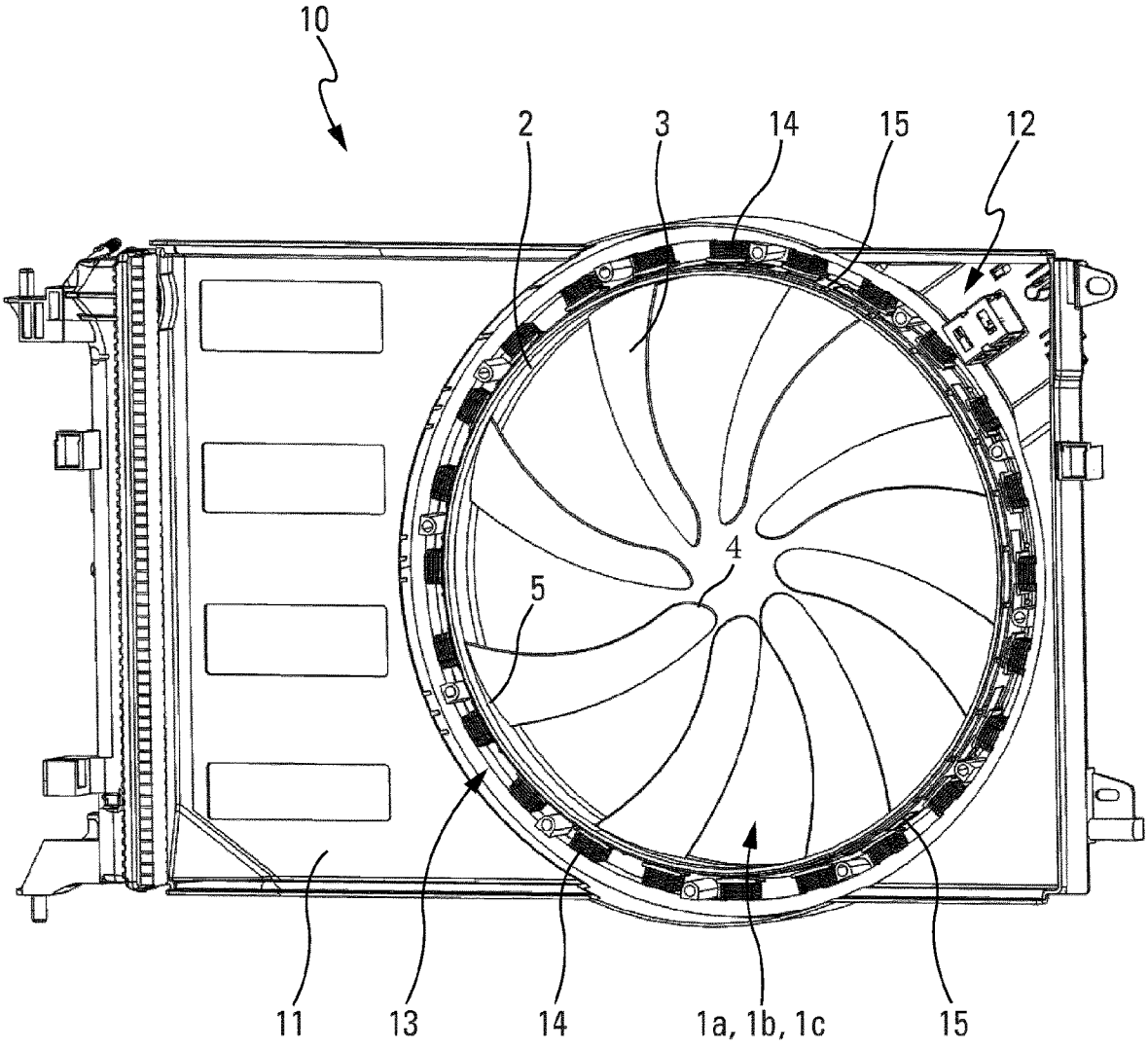
FIG. 5 is a perspective view showing a motor-fan unit equipped with an impeller conforming to the first embodiment of the present invention and in which a device for driving the impeller includes electromagnetic elements.
Figure 6:
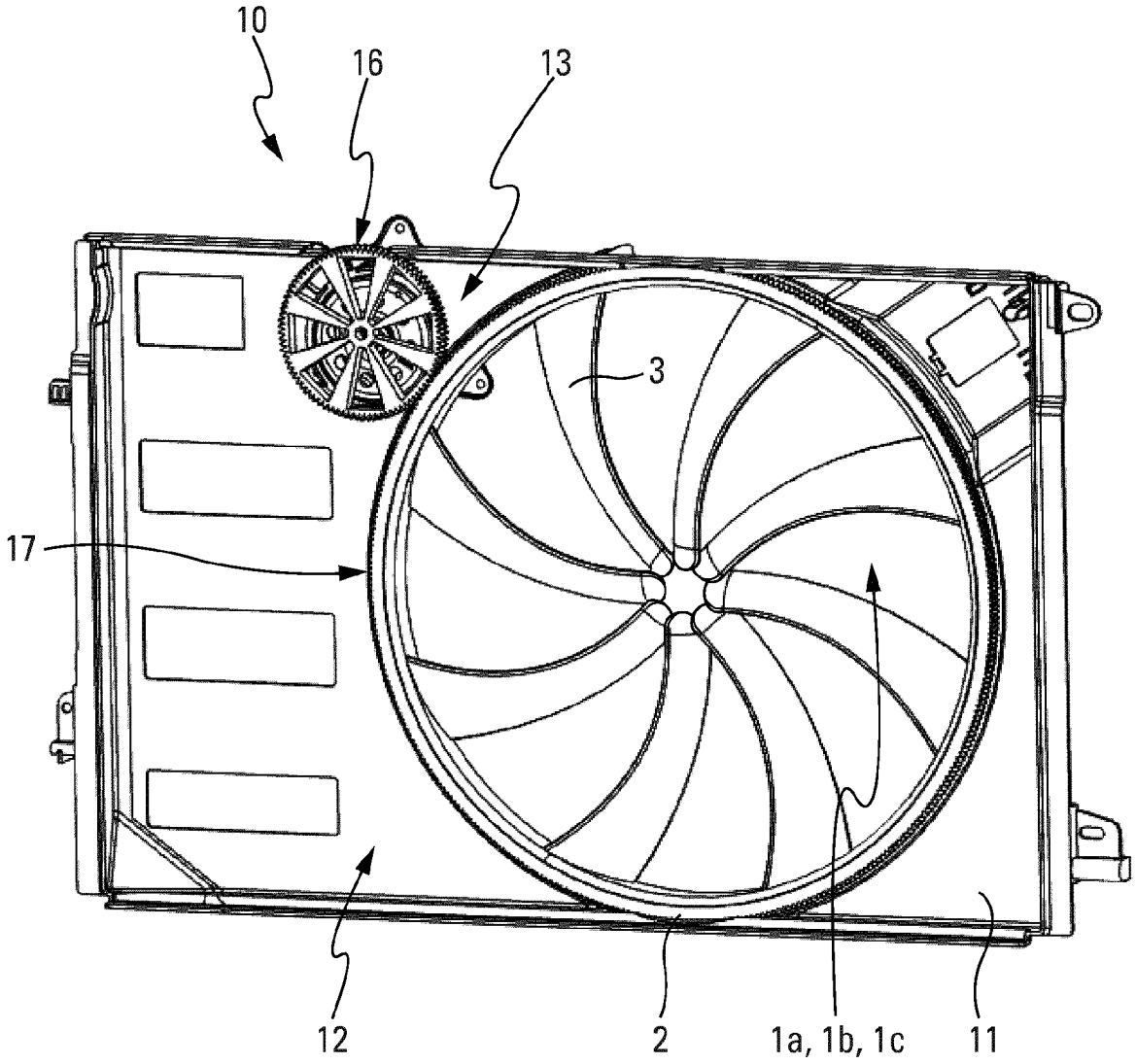
FIG. 6 is a perspective view showing a variant embodiment of the motor-fan unit equipped with an impeller conforming to the first embodiment of the present invention and in which a device for driving the impeller includes gears.
Figure 7:
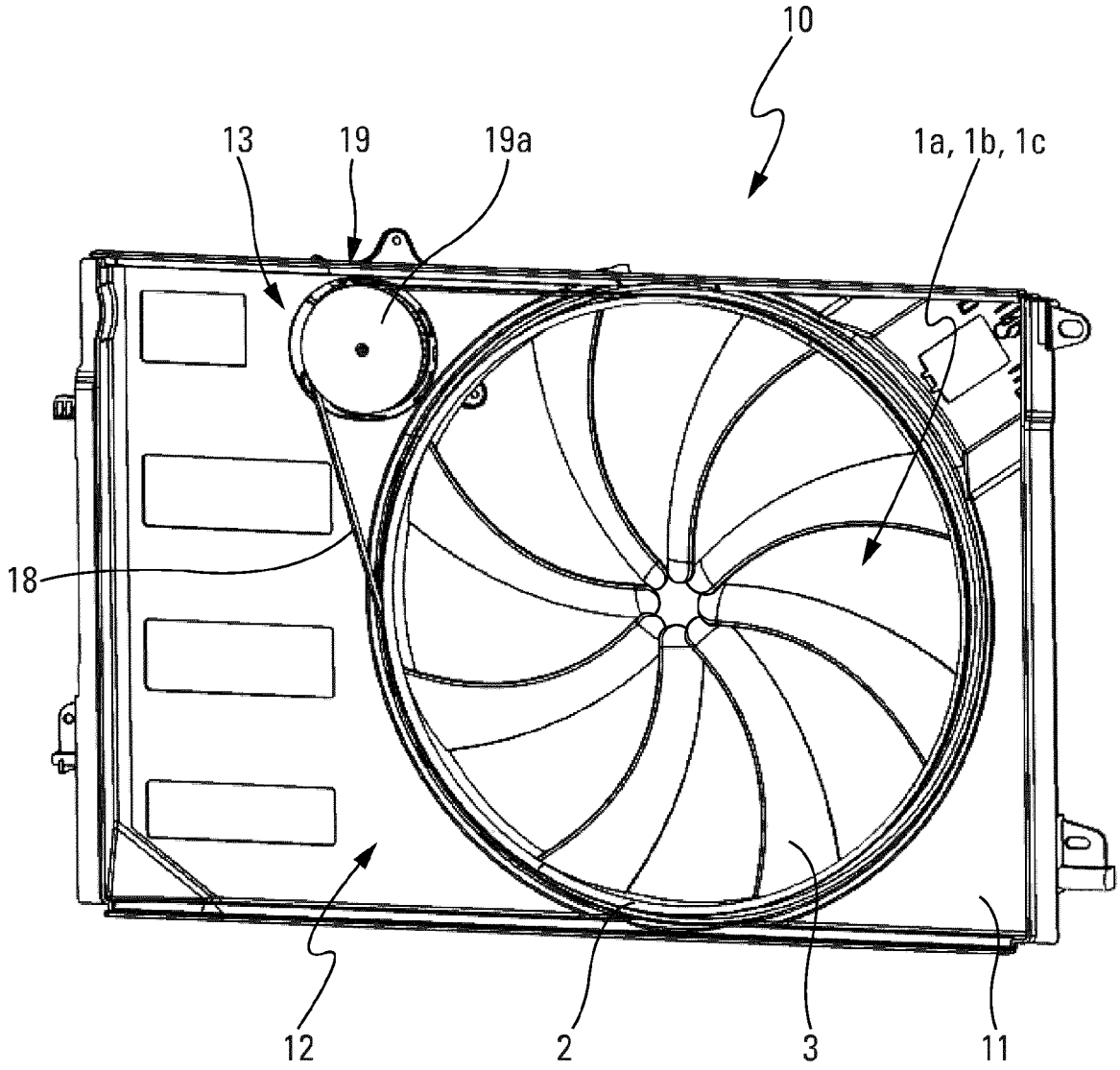
FIG. 7 is a perspective view showing a variant embodiment of the motor-fan unit equipped with an impeller conforming to the first embodiment of the invention and in which a device for driving the impeller includes a belt.

In a manner common to FIGS. 5 to 7, the motor-fan unit 10 comprises a support 11 on which is mounted a fan 12, with the fan 12 including the impeller 1*a*, 1*b*, 1*c* and a device 13 for driving the impeller 1*a*, 1*b*, 1*c* in rotation. To be more precise, the support 11 comprises an opening in which the impeller 1*a*, 1*b*, 1*c* is situated. FIGS. 5 to 7 show three types of possible driving device 13 for driving an impeller 1*a*, 1*b*, 1*c* of this kind having a free central zone ϕ and the possible configurations that the impeller 1*a*, 1*b*, 1*c* may adopt in order to cooperate with those drive devices 13.

FIG. 5 shows a first embodiment of the motor-fan unit 10 in which the drive device 13 comprises electromagnetic or magnetic devices of coil 14 or magnet type. To be more precise, in accordance with this embodiment the drive device 13 comprises 24 coils distributed uniformly with respect to one another about the rotation axis RO of the impeller 1*a*, 1*b*, 1*c*. In accordance with a variant embodiment the drive device 13 comprises four coils 14 disposed at 90 degrees to one another about the rotation axis RO of the impeller 1*a*, 1*b*, 1*c*. For its part, the impeller 1*a*, 1*b*, 1*c* also comprises electromagnetic or magnetic elements 15 having properties enabling cooperation with the magnetism induced by the coils 14 of the drive device 13 in order for the magnetic field to drive the impeller motor 1*a*, 1*b*, 1*c* in rotation. As FIG. 5 shows the electromagnetic elements 15 of the impeller 1*a*, 1*b*, 1*c* are magnets and are preferably situated on the cylindrical ring 2 of the impeller 1*a*, 1*b*, 1*c*.

The embodiments illustrated by FIGS. 6 and 7 differ from the embodiment illustrated by FIG. 5 in the sense that the impeller 1*a*, 1*b*, 1*c* is driven by a drive device of mechanical type.

FIG. 6 shows a second embodiment of the motor-fan unit 10 in which the drive device 13 comprises gears 16. To be more precise, in accordance with this embodiment motorized gears 16 are situated on a front face of the support 11 and cooperate with an electric motor (not visible) situated on a rear face of the support 11, the front face and the rear face being two faces of the support 11 parallel to and opposite one another along the rotation axis RO of the impeller 1*a*, 1*b*, 1*c*. The motorized gears 16 and the motor are disposed at the periphery of the impeller 1*a*, 1*b*, 1*c*. By this is meant that this drive device 13 does not take up any space on the available area of the impeller 1*a*, 1*b*, 1*c*.

In order for the impeller 1*a*, 1*b*, 1*c* to be driven in rotation by these motorized gears 16, it comprises teeth 17. To be more precise it is the cylindrical ring 2 that comprises the teeth 17 in order to cooperate with the gears 16. The teeth 17 may consist of an attached part taking the form of a cylindrical rim that is clipped onto the cylindrical ring 2 of the impeller 1*a*, 1*b*, 1*c*. In accordance with a variant embodiment the teeth 17 and the cylindrical ring 2 are made in one piece.

FIG. 7 shows a third embodiment of the motor-fan unit 10 in which the drive device 13 comprises a belt 18 for driving the impeller 1*a*, 1*b*, 1*c* and a mechanism 19 for driving the belt 18. To be more precise, the mechanism 19 comprises a pulley 19*a* on which the belt 18 is intended to be driven and an electric motor (not visible) driving the drive pulley 19*a* in rotation. In accordance with this embodiment the drive pulley 19*a* of the mechanism 19 is situated on the front face of the support 11 and cooperates with the electric motor situated on the rear face of the support 11. The belt 18 cooperates with the cylindrical ring 2 of the impeller 1*a*, 1*b*, 1*c* in order to drive it in rotation. To this end the impeller 1*a*, 1*b*, 1*c* and to be more precise the cylindrical ring 2 is configured to receive the belt 18. In the embodiment shown the cylindrical ring 2 of the impeller 1*a*, 1*b*, 1*c* comprises a shoulder, such as that visible in FIGS. 1A to 2B, to retain the belt 18 and to prevent disengagement of the belt 18 from the impeller 1*a*, 1*b*, 1*c*. In accordance with a variant embodiment the impeller 1*a*, 1*b*, 1*c* comprises a groove to receive the belt 18 and to retain it in place.

In all the embodiments of the motor-fan unit 10 that have just been described the drive device 13 is situated at the periphery of the impeller 1*a*, 1*b*, 1*c*, on the support 11 and cooperates with the cylindrical ring 2 of the impeller. In other words, the drive device 13 is situated outside the opening in which the impeller 1*a*, 1*b*, 1*c* is situated. This ensures that the drive device 13 does not generate a dead zone in front of the impeller 1*a*, 1*b*, 1*c*.

Figure 8A:
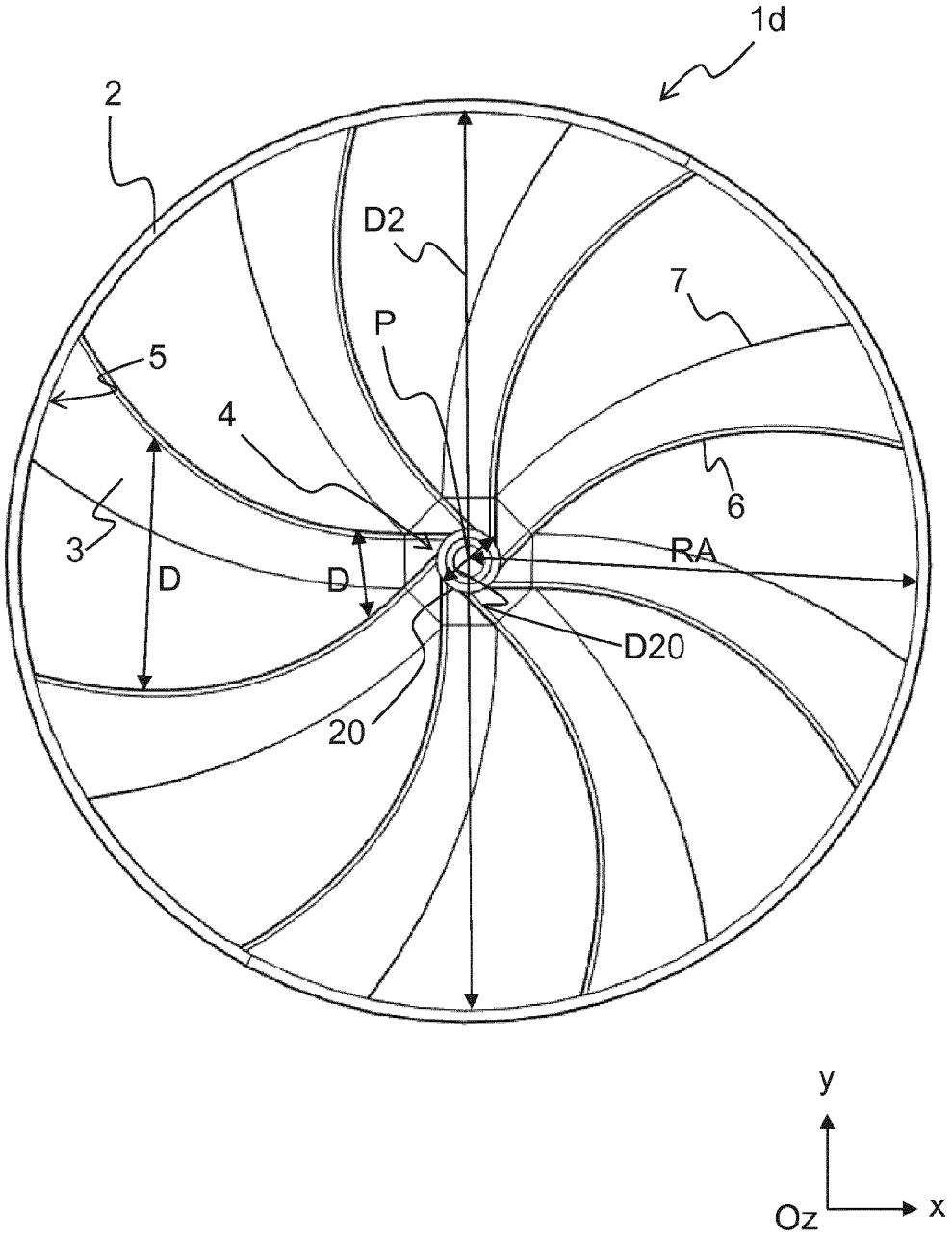
FIGS. 8A to 8D are perspective views from different angles or sectional views of a first embodiment of a motor vehicle fan impeller conforming to a second embodiment of the present invention, referred to as the third impeller.

FIG. 8A shows the impeller 1*d*, also referred to as the third impeller 1*d*, of a motor vehicle fan comprising the cylindrical ring 2 having a diameter D2 and a central hub 20 inscribed in the cylindrical ring 2 having a diameter D20 less than the diameter D2 of the cylindrical ring 2. In accordance with this embodiment, the central hub 20 and the cylindrical ring 2 are concentric with the center P, which also corresponds to the center of the impeller 1*d*. The diameter D2 of the cylindrical ring 2 is preferably an inside diameter, that is to say the smallest diameter of the cylindrical ring 2. This diameter D2 is representative of the agitation area of the impeller 1*d* through which the agitated fluid circulates through the impeller 1*d*. The inside radius RA of the cylindrical ring 2 coincides with the inside radius of the impeller 1*d*.

The impeller 1*d* comprises blades 3 extending between the cylindrical ring 2 and the central hub 20. To be more precise each blade 3 has two radially opposite ends 4, 5 referred to as the blade root end 4 and the blade tip end 5. By radially opposite is meant that along a radius RA of the impeller 1*d* or of the cylindrical ring 2 the blade root end 5 is situated farthest from the center P while the blade root end 4 is situated closest to the center P, for the same blade 3. Moreover, the blade root end 4 is secured to the central hub 20 while the blade tip end 5 is secured to the cylindrical ring 2. To this end the blades 3 and the cylindrical ring 2 are molded in one piece to form the impeller 1*d*.

Figure 8B:
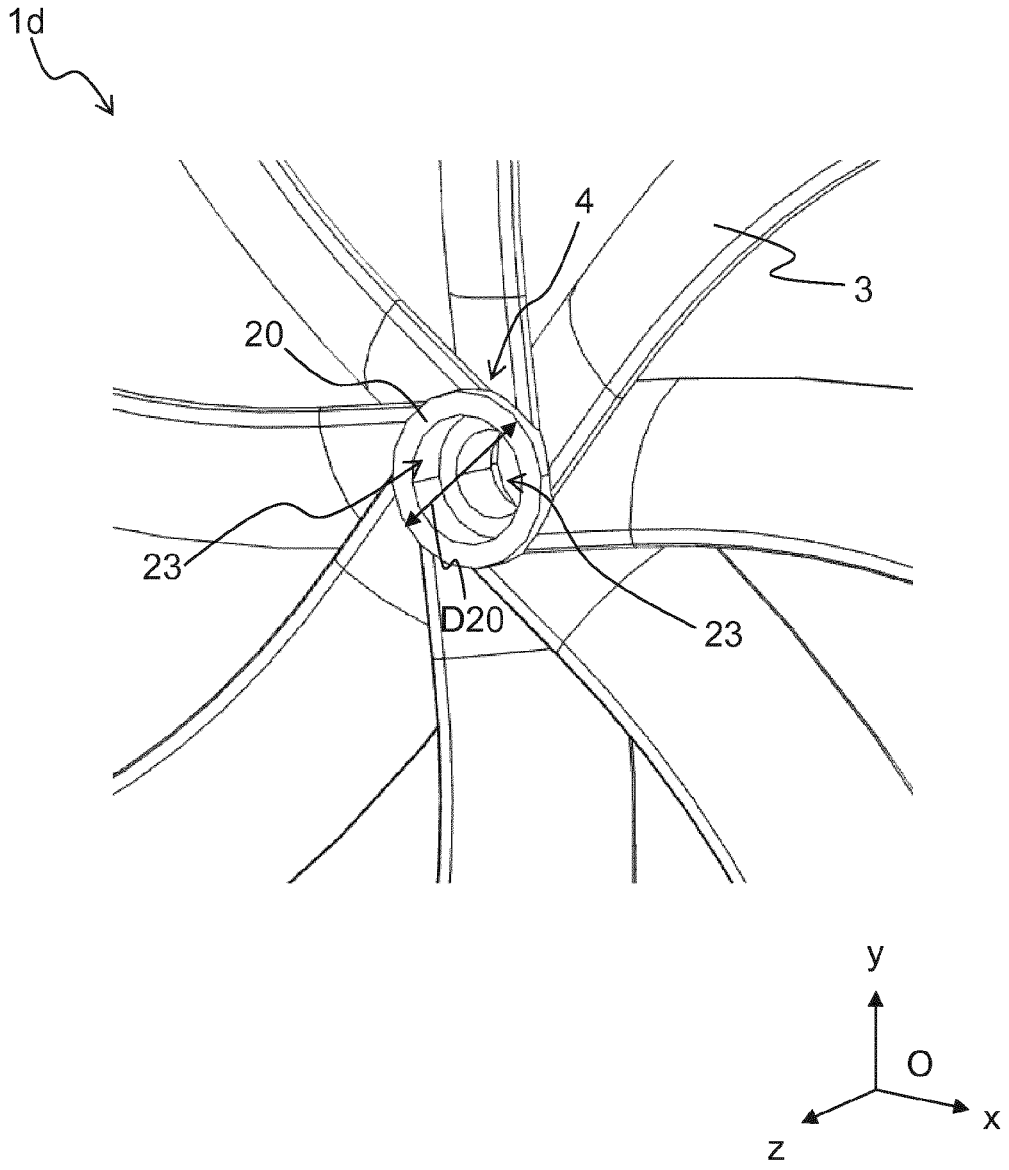
Figure 8C:
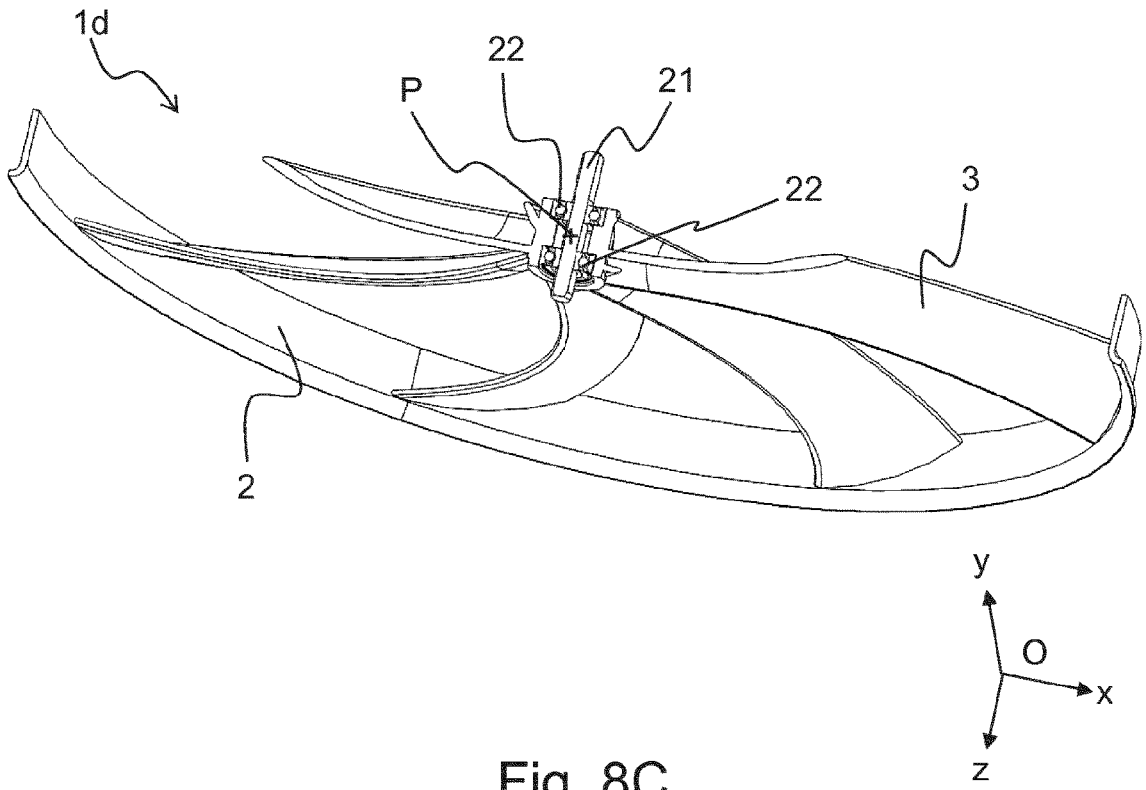
Figure 8D:
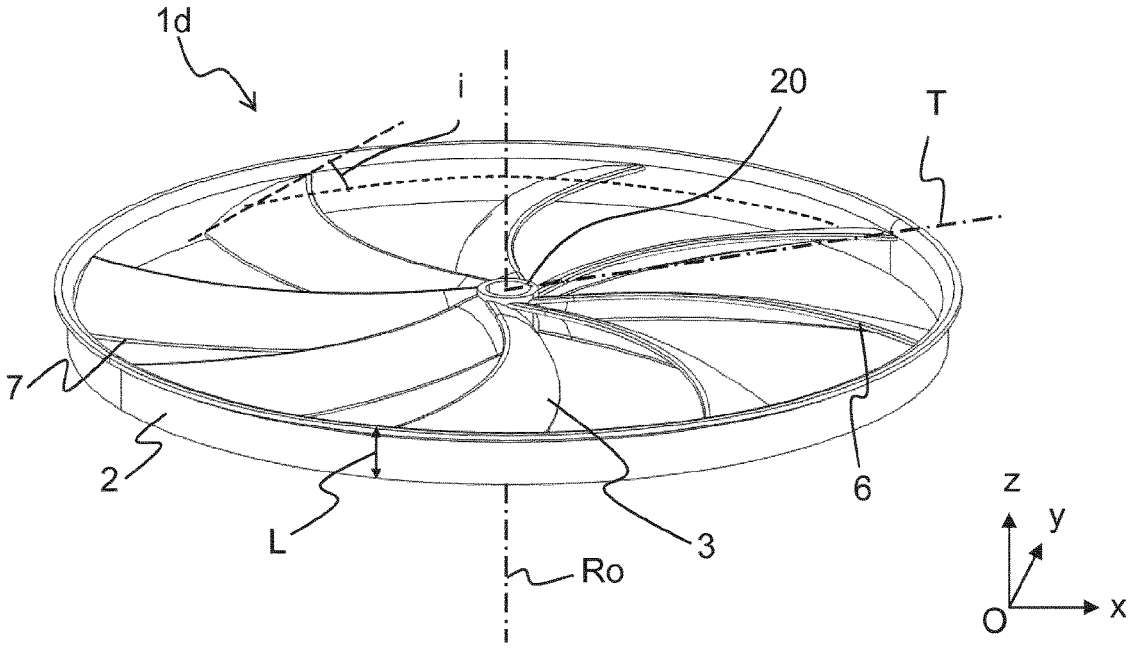

It is to be noted that in the context of an application to a motor-fan unit the cylindrical ring 2 has an outside diameter between 38 and 42 centimeters inclusive and a width L between 2 and 5 centimeters inclusive, the direction L being measured in a direction following the rotation axis RO of the impeller 1*d* (cf. FIG. 8D). Moreover, in the context of an application to the field of motor vehicles the fluid agitated by the impeller 1*d* is air.

In order to maximize the usable area of the impeller 1*d* and to improve its performance the diameter D20 of the central hub 20 is less than or equal to 15% of the diameter D2 of the cylindrical ring 2. In other words, this means that the impeller 1*d* has a central hub 20 of small size compared to the size of the impeller 1*d* and in particular relative to the diameter of the cylindrical ring 2 defining the size of the impeller 1*d*.

The role of a central hub 20 of this kind is to retain the impeller 1*d* on its rotation axis RO and it is not intended to support an electric motor for driving the impeller 1*d* in rotation. In other words, the central hub 20 is defined as being a central part of the hub 1*d* onto which are assembled the parts, such as the blades 3, that have to turn about the rotation axis RO. A motor for driving the impeller is necessary, but as will be described hereinafter with reference to FIGS. 13 to 16 this is situated at the periphery of the impeller 1*d*. Thus by reducing the size of the central hub 20 the area of the impeller 1*d* available for agitation the fluid is increased and the performance of the impeller is therefore improved.

In order to compare the diameters D2, D20 of the hub 20 and of the cylindrical ring 2, it is to be noted that preferably only the diameters defining the agitation area of the impeller 1*d* are considered. To this end the inside diameter D2 of the cylindrical ring 2 is taken into account and the outside diameter D20 of the central hub 20 is taken into account. By inside diameter and outside diameter are meant respectively a diameter closer to or more distant from the center of the measured element, that is to say a diameter closer to or more distant from the center P of the cylindrical ring 2 or of the central hub 20.

The relationship between the two diameters D2, D20 is sufficiently small to avoid a dead zone situated along the rotation axis RO and to prevent generation of unwanted turbulence. In fact, when the diameter D20 of the central hub is greater than 15% of the diameter D2 of the cylindrical ring 2 the dead zone around the rotation axis RO is generated in which air does not circulate, because not reached by the blades 3 and the agitated flow of air. In some cases it is even preferable for the diameter D20 of the central hub 20 to be less than or equal to 10% of the diameter D2 of the cylindrical ring 2 to be sure that air is agitated over all the agitation area of the impeller 1*d*. In accordance with a particularly advantageous embodiment the outside diameter D20 of the central hub 20 is between 3 and 4 centimeters inclusive and its width is the same as the width L of the cylindrical ring 2.

FIGS. 8B and 8C show an embodiment of the central hub 20 of the impeller 1*d*. In order to retain the impeller 1*d* on its rotation axis RO the central hub 20 is intended to receive a stationary pin 21 secured to a fixed support, as will be described hereinafter with reference to FIGS. 13 to 15. In order for the impeller 1*d* to be mobile in rotation relative to the pin 21 the central hub 20 is intended to receive two rotation bearings 22. To this end the central hub 20 comprises as many spot faces 23 as there are rotation bearings 22, thus two counterbores here. The counterbore 23, the rotation bearing 22 and the pin 21 are concentric with the center P of the central hub 20. In accordance with a variant embodiment the pin 21 is replaced by a shaft 21*a* mobile in rotation in order to participate in driving the impeller 1*d* in rotation. To this end, and as will be described with reference to FIGS. 16A and 16B, the central hub 20 is intended to be constrained to rotate with this shaft 21*a* mobile in rotation.

Figure 13A:
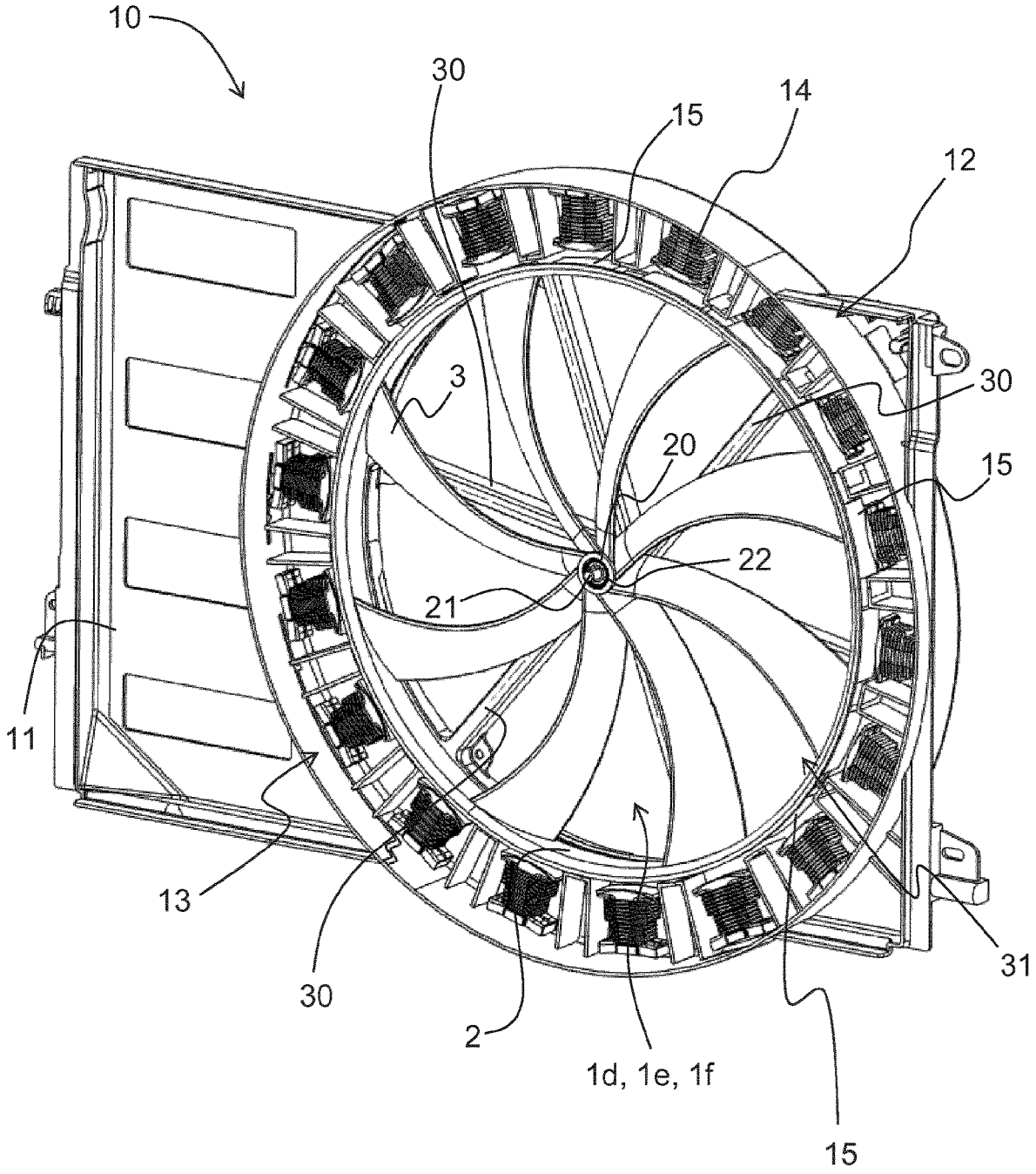
FIG. 13A is a perspective view showing a first embodiment of the motor-fan unit equipped with an impeller conforming to the second embodiment of the present invention and in which a device for driving the impeller includes electromagnetic elements.
Figure 13B:
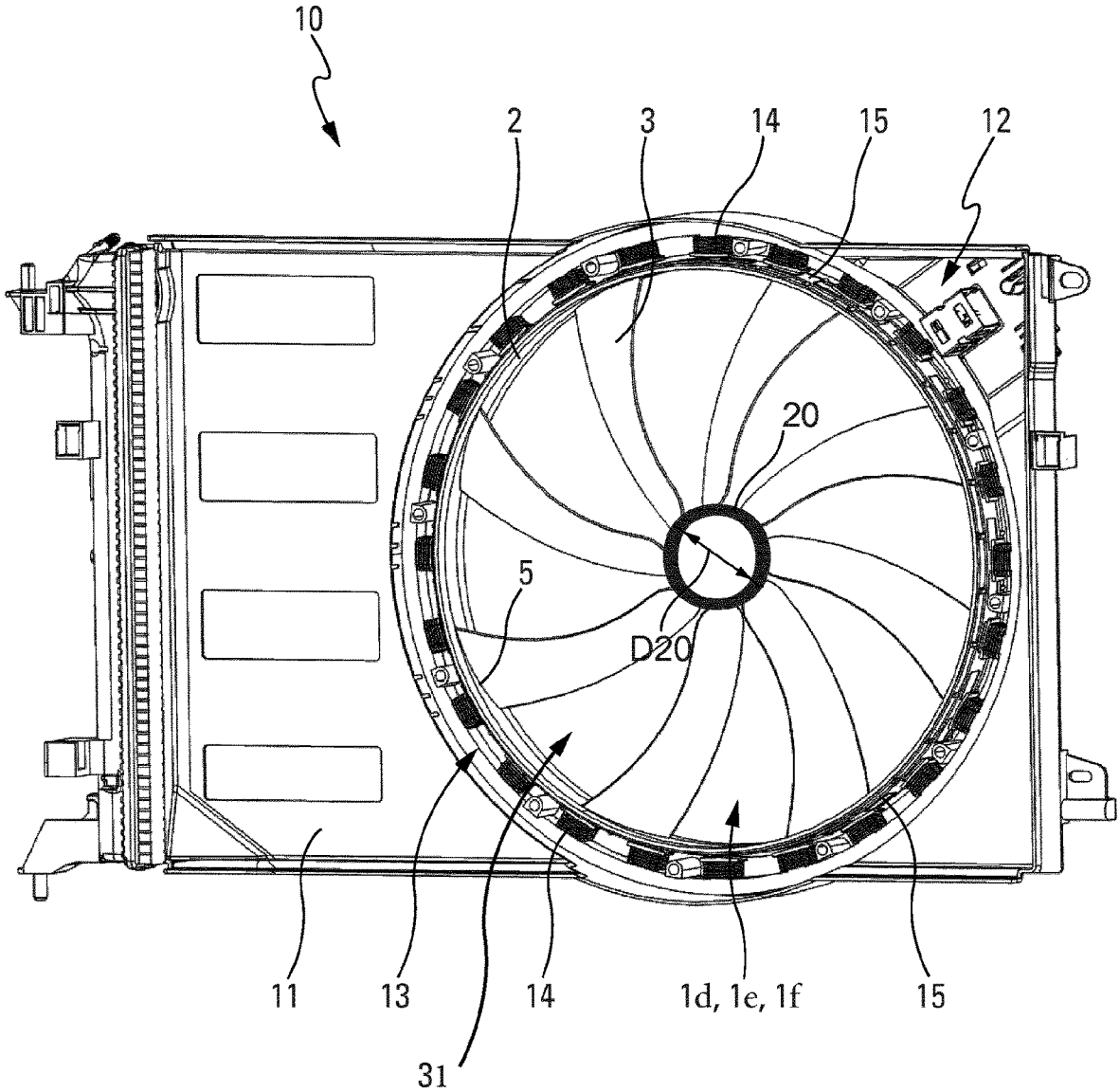
FIG. 13B is a perspective view showing a variant embodiment of the first embodiment of the motor-fan unit shown in FIG. 13A.

In accordance with another variant embodiment shown in FIG. 13B the central hub 20 takes the form of a ring in which a zone is left free so as to form a fluid passage through the central hub. In this case the role of the central hub 20 is only to fasten the blades 3 of the impeller 1*a* to one another. The driving of an impeller 1*d* of this kind will be described with reference to FIG. 14.

Moreover, the impeller 1*d* shown in FIG. 8A comprises eight blades 3. The more blades 3 there are the more power can be transferred to the agitated fluid by the impeller 1*d* and therefore the greater the volume of agitated fluid. Of course, depending on what is required, the number of blades 3 equipping the impeller 1*d* may be revised up or down. The eight blades 3 are preferably distributed in a symmetrical manner on the impeller 1*d*. By this is meant that the same points on the blades 3 are regularly spaced from one another by a distance D. The distance D is shorter than at the level of the blade 3 roots than at the level of the blade 3 tips. It is to be noted that the impeller 1*d* is of axial type in the sense that it stirs a flow of air in a direction colinear with the direction in which the flow of air is aspirated.

The blades 3 are entirely contained within the cylindrical ring 2 and do not project beyond the cylindrical ring 2, in particular in a radial direction. Moreover, the width L of the cylindrical ring 2 measured along the rotation axis RO of the impeller 1*d* is such that the blades 3 are entirely contained within the interior volume delimited by the cylindrical ring 2. It is then clear that the blades 3 do not project beyond the cylindrical ring 2, in particular in a direction parallel to the rotation axis RO of the impeller 1*d*. In accordance with the example shown the cylindrical ring 2 has a width of 2.5 centimeters.

Moreover, as FIG. 8B shows, note that the blades 3 are superposed on one another about the central hub 20 and are inclined by an inclination angle I on the cylindrical ring 2. In accordance with this embodiment, the inclination angle I of the blade root end 5 on the cylindrical ring 2 is equal to 25 degrees to within the manufacturing tolerances.

Other shapes of blades 3 are possible and are described hereinafter with reference to FIGS. 9A to 10B.

Figure 9A:
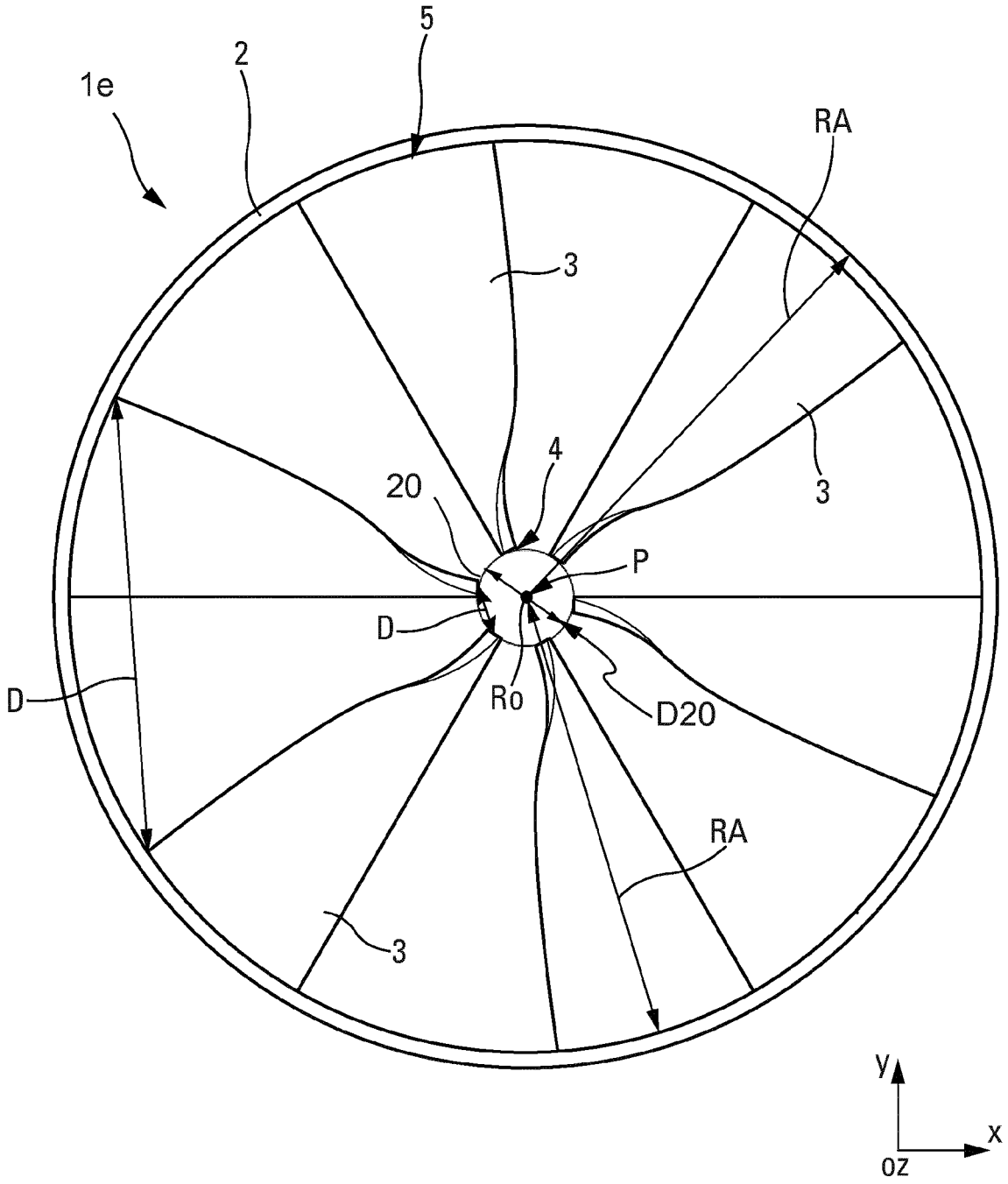
FIGS. 9A and 9B are respectively front and perspective views of a second embodiment of a motor vehicle fan impeller conforming to the second embodiment of the invention, referred to as the fourth impeller and in which the blade root ends are twisted to the maximum.
Figure 9B:
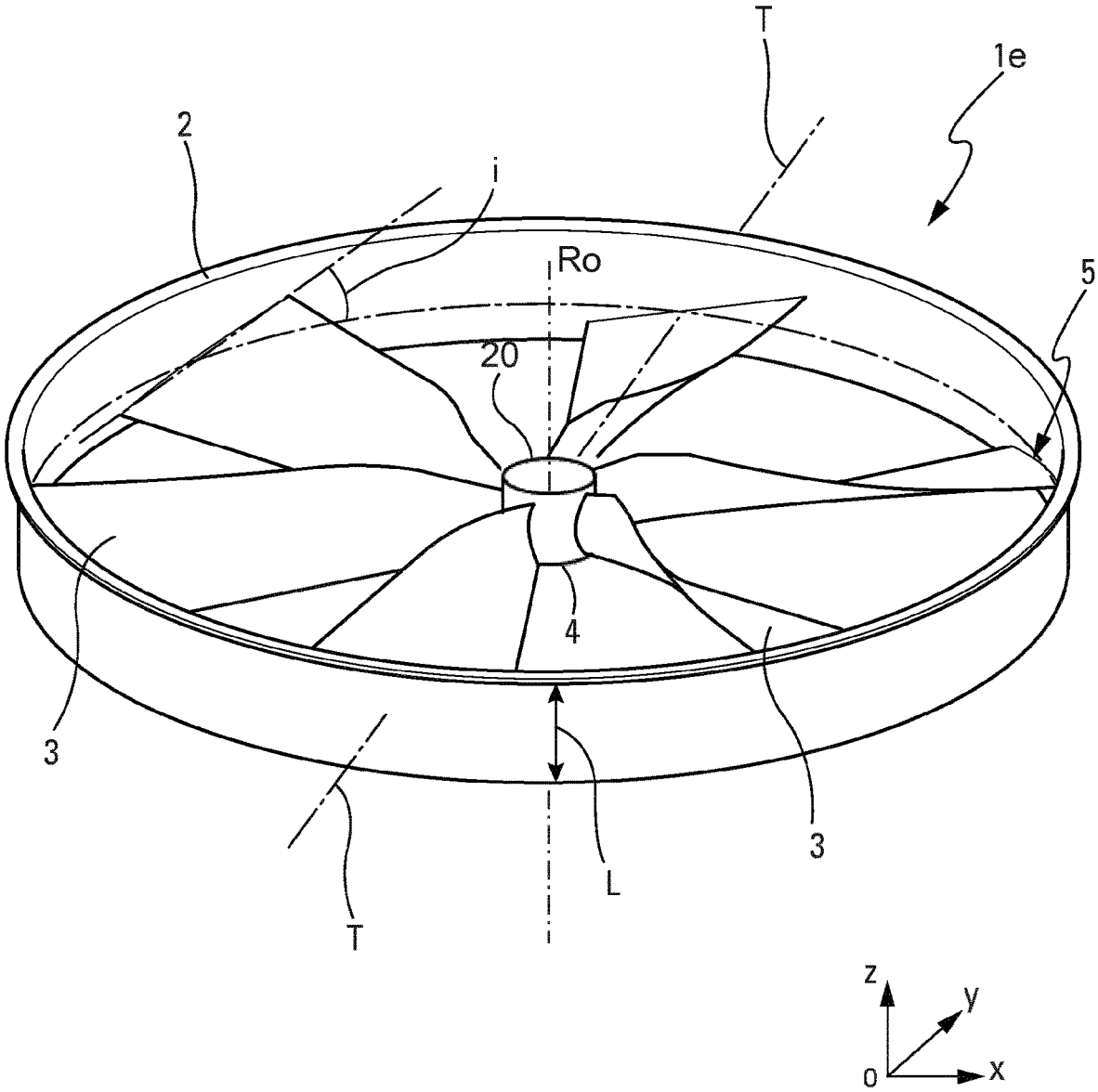

FIGS. 9A to 9F show a variant embodiment of the blades 3 of the impeller 1*d*. For clarity the impeller carrying these blades is referred to as the fourth impeller 1*e*. In the same manner, another variant embodiment of the blades 3 is illustrated by FIGS. 9A and 9B and the impeller carrying these blades 3 will be referred to as the fifth impeller 1*f* in the remainder of the description.

FIG. 9A shows the fourth impeller 1*e* comprising six blades 3. It is to be noted that in the context of an application to a motor-fan unit six blades 3 represents an optimum in terms of fluid agitation and sizing the impeller 1*e*.

The six blades 3 are preferably distributed in a symmetrical manner on the impeller 1*e*. There is meant by this that the same points on the blades 3 are regularly spaced from one another by a distance D. The distance D being smaller at the level of the blade root ends 4 than at the level of the blade tip ends 5. In accordance with a variant embodiment the blades 3 are disposed in an asymmetric manner to reduce or to prevent tonal noise, to which end the distance D is different from one blade 3 to another.

As can be seen better in FIGS. 9B to 9F, the blades 3 may be entirely contained within the cylindrical ring 2 and not project beyond the cylindrical ring 2, in particular in a radial direction. Moreover, the width L of the cylindrical ring 2 measured along the rotation axis RO of the impeller 1*e* is such that the blades 3 are entirely contained within the interior volume delimited by the cylindrical ring 2. It is then clear that the blades 3 do not project beyond the cylindrical ring 2, in particular in a direction parallel to the rotation axis RO of the impeller 1*e*. In accordance with the example shown the cylindrical ring 2 has a width of 4.5 centimeters.

Moreover, FIGS. 9B to 9F show that the blades 3 have a twisted profile from the blade tip end 4 to the blade root end 5, the twist being defined about a torsion axis T. In accordance with this embodiment, the torsion axis T around which the blades 3 are twisted coincides with a radius RA of the impeller 1*e* or of the cylindrical ring 2. By twist is meant that each blade 3 has a profile having undergone a deformation by a rotation about an axis, here the radial axis RA of the impeller 1*e*.

The impeller 1*e* shown in FIGS. 9A to 9F has blade root ends 4 that have undergone greater twisting than the blade tip ends 5. In fact, as can be seen in the FIG. 9C section, the blade root end 4 has a chord C1 parallel to the rotation axis RO of the impeller 1*e*. The chord C of a blade 3 corresponds to the straight line segment connecting the leading edge 6 and the trailing edge 7 of the blade 3 in a cross section of the blade 3. Thus the angle that the chord C1 and the rotation axis RO of the impeller 1*e* form, also referred to as the pitch angle A, is 0 and the twist is therefore maximum. Generally speaking, the blade root end 4 has a pitch angle A between 0 and 10 degrees inclusive. This pitch angle A is measured by projection onto a median plane of the impeller 1*e* entirely containing the rotation axis RO.

Moreover, in accordance with this example as shown the chord C1 of this blade root end 4, is equal to 2.5 centimeters. In the context of an application to a motor-fan unit the chord C1 of the blade root end 4 is between 2 and 3 centimeters inclusive. The chord C1 of the blade root end 4 being non-zero, it is certain that this blade root end 4 will not be pointed.

Figure 9C:
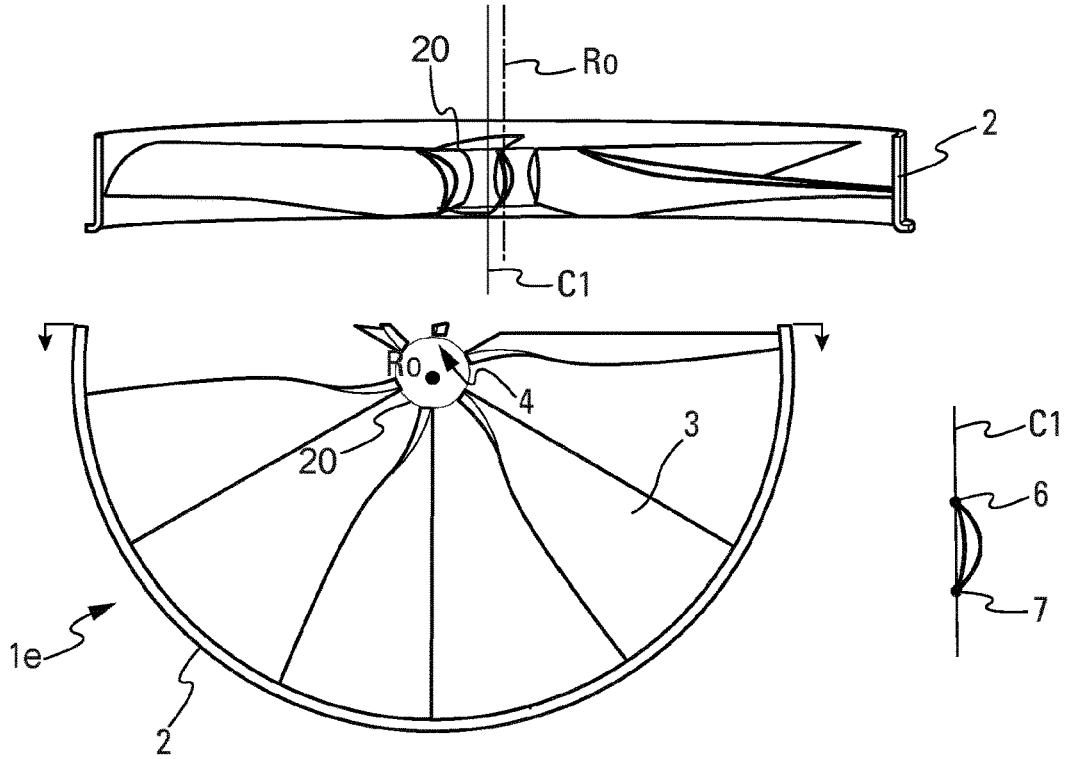
FIGS. 9C to 9E are views in section of the third impeller from different angles and at different blade heights.
Figure 9D:
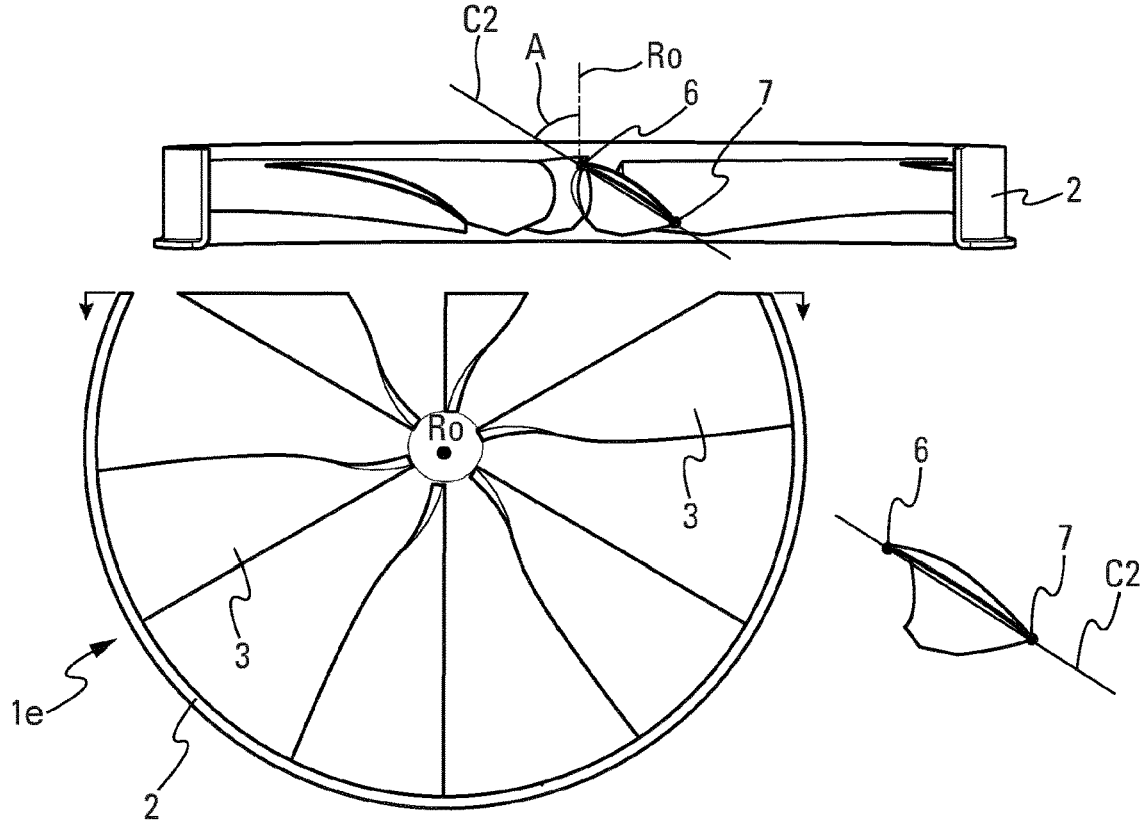

FIG. 9D shows a blade 3 section taken between the blade root end 4 and the blade tip end 5. It is then seen that the twist is open relative to the section of FIG. 9C. To be more precise, the section shown in FIG. 9D has a chord C2 forming a pitch angle A of 60 degrees with the rotation axis RO to within the manufacturing tolerances.

Figure 9E:
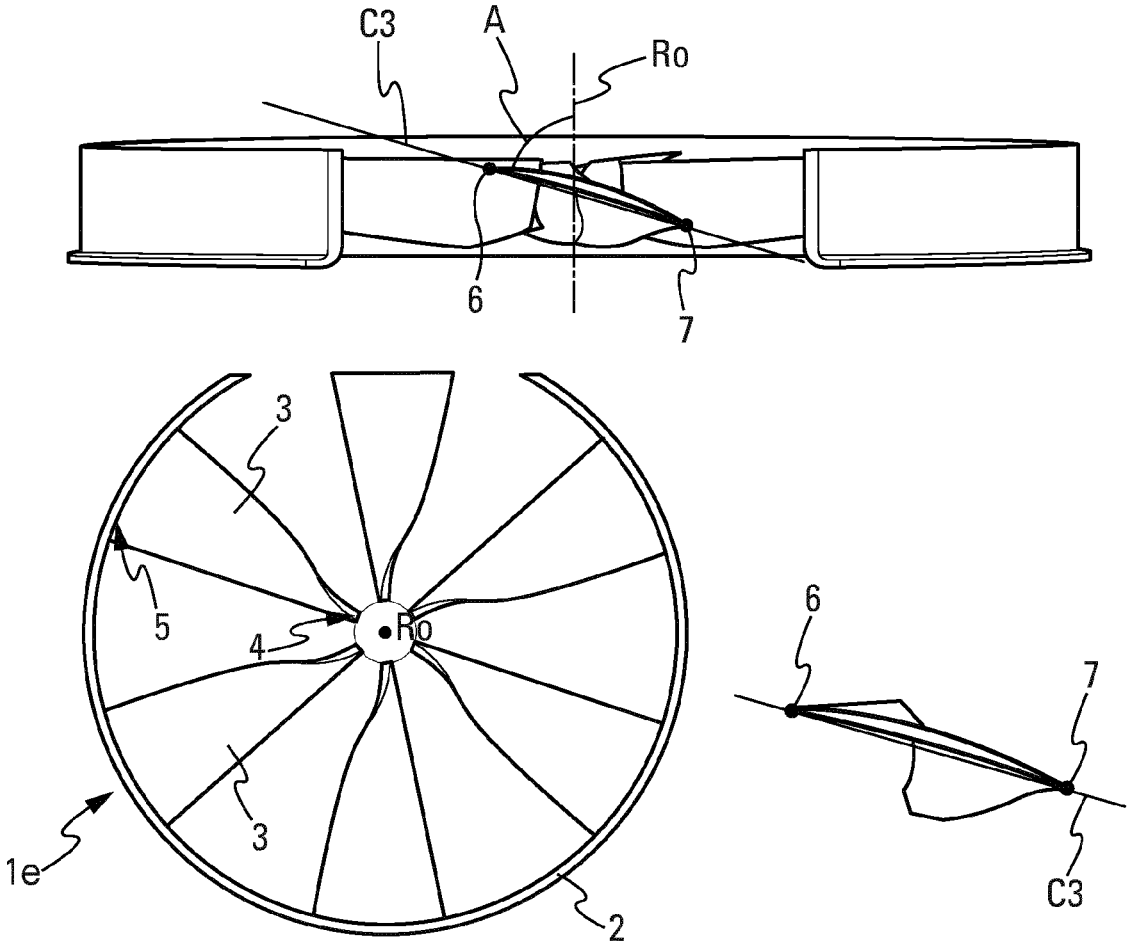

FIG. 9E then shows that the section of the blade tip end 5 has a chord C3 forming a pitch angle A of 75 degrees with the rotation axis RO to within the manufacturing tolerances. As a general rule, the blade tip end 5 has a chord C3 forming a pitch angle A between 40 and 80 degrees inclusive with the rotation axis RO of the impeller 1*e*. It is then clear that the nearer the blade tip end 5 along a given blade 3 the more the pitch angle A increases and the twist decreases. When the blade root end 5 has a chord C3 perpendicular to the rotation axis RO of the impeller 1*e* the blade tip end 5 is not inclined on the cylindrical ring 2. In fact, as can be seen in FIG. 9B, the blade tip end 5 forms an inclination angle I with the cylindrical ring 2, that angle I being the difference between 90 degrees and the pitch angle A, that is to say 90−75=15 degrees.

Moreover, in accordance with the example shown in FIG. 9E the chord C3 of this blade tip end 5 is equal to 8.5 centimeters. In the context of an application to a motor-fan unit, the chord C3 of the blade tip end 5 is between 8 and 13 centimeters inclusive. It is then seen that the blade root end 4 has a chord C1 less than the chord C3 of the blade tip end 5. It is then clear that the blade root end 4 is smaller than the blade tip end 5.

Figure 9F:
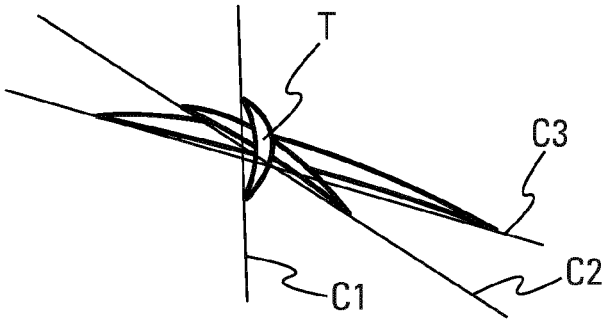
FIG. 9F represents a superimposition of the three blade sections seen in FIGS. 2C to 2E.
Figure 10A:
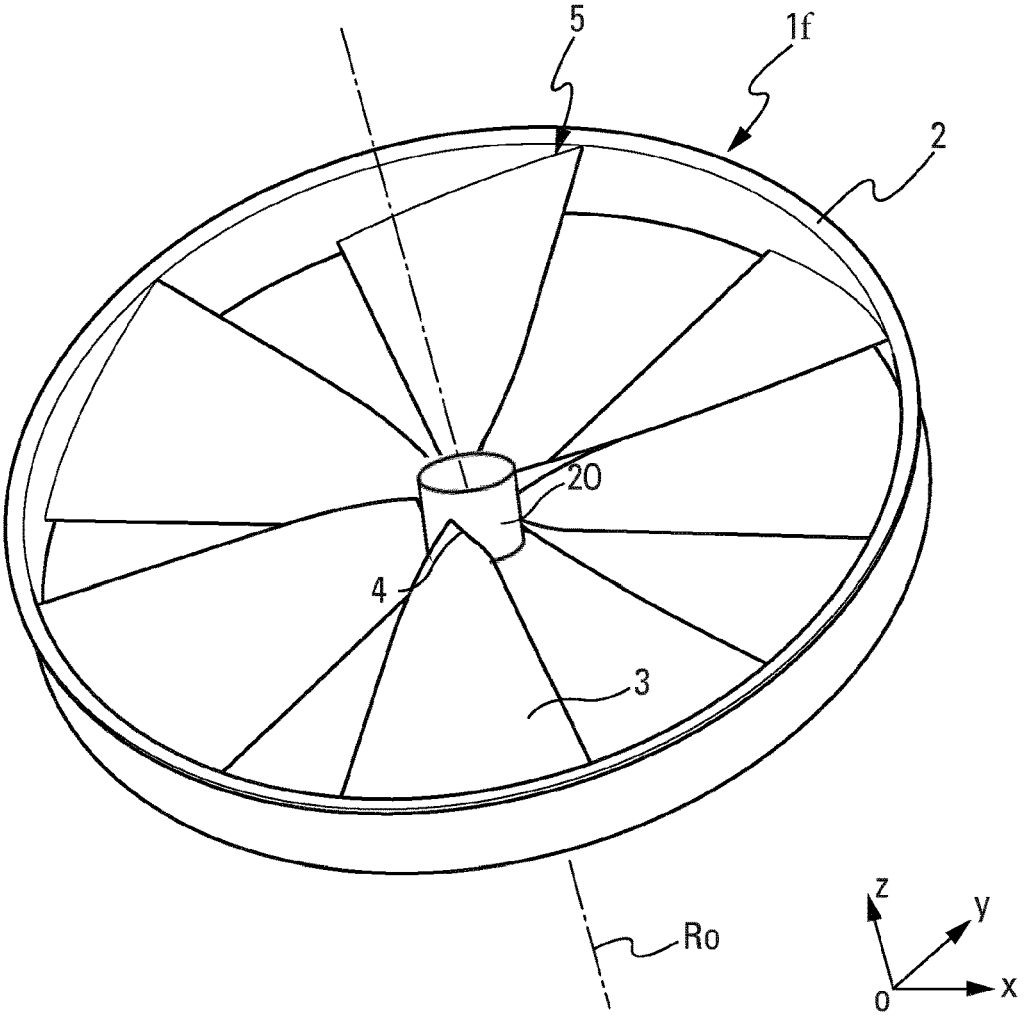
FIG. 10A is a perspective view of a third embodiment of a motor vehicle fan impeller conforming to the second embodiment of the present invention, referred to as the fifth impeller and in which the blade root ends are less twisted than those of the blades of the fourth impeller.
Figure 10B:
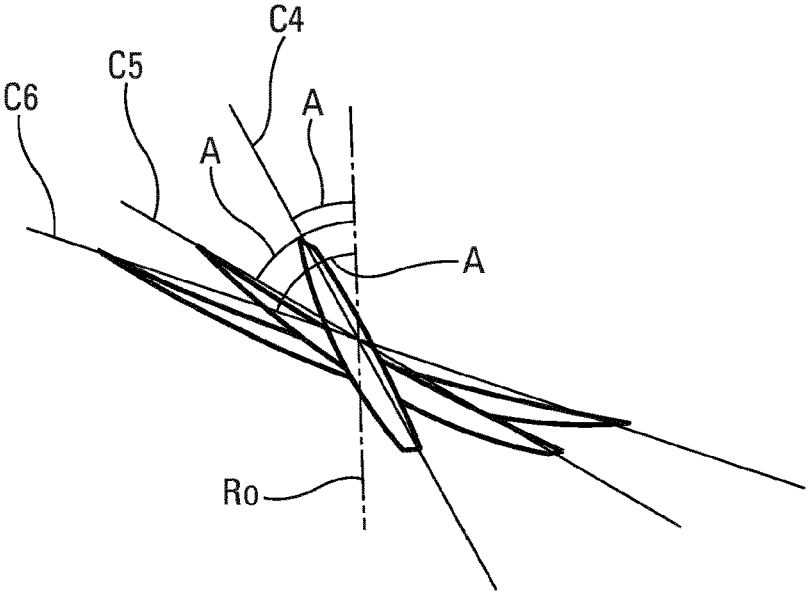
FIG. 10B represents a superimposition of three sections of one of the blades of the fifth impeller.

FIG. 9F, representing the various sections from FIGS. 9C to 9E superimposed on one another, shows the evolution of the chord C1, C2, C3 along the blade 3 and around the torsion axis T. The pitch angle A along a blade 3 is therefore between 0 and 80 degrees inclusive to within the manufacturing tolerances.

It is to be noted that the blades 3 equipping the impeller 1*e* are all identical to one another. To be more precise, each blade 3 follows a NACA 65(24)10 aerodynamic profile. NACA profiles correspond to aerodynamic profiles designed for the wings of aircraft developed by the Comité consultatif national pour l'aéronautique (NACA). The shape of NACA profiles is described by a series of digits that follow the abbreviation "NACA". The parameters in the numerical code may be entered into equations to generate accurately the section of a blade and to calculate its properties. For the NACA 65(24)10 aerodynamic profile the 6 refers to series 6, the 5 corresponds to the position relative to the chord of the minimum pressure at the extrados, i.e. 50% of the chord, at which location there is generally also the maximum thickness, 24 corresponds to the lift coefficient at zero incidence, i.e. the aerodynamic camber coefficient multiplied by 10, denoted Cz∞0 and finally 10 corresponds to the maximum thickness relative to the chord as a percentage.

FIGS. 9A and 9B show a variant embodiment of the impeller 1*d* and 1*e* according to the invention, that will be referred to as the fifth impeller 1*f* in the remainder of the description. This fifth impeller 1*f* also includes six blades 3 inscribed in the cylindrical ring 2 that is at all points identical to that of the fourth impeller 1*e* shown in FIGS. 9A to 9F. In other words, the blades 3 of this fifth impeller 1*f* also have free blade root ends 4. Moreover, these blades 3 are all identical to one another and also follow a NACA 65(24)10 type aerodynamic profile.

The only differences from the fourth impeller 1*e* lie in the dimensions of the blades 3 and the pitch angle A. As can be seen in FIG. 9B, the superimposition of the three sections of blades 3 of the fifth impeller 1*f* shows that the chord C4 of the blade root end 4 forms a pitch angle A of 30 degrees with the rotation axis RO of the impeller 1*f*, the chord C5 of the section taken between the two ends 4, 5 of the blades 3 forms a pitch angle A of 70 degrees with the rotation axis RO, and the chord C6 of the blade root end 4 forms a pitch angle A of 80 degrees with the rotation axis RO of the impeller 1*f*. Thus along a blade 3 the pitch angle A evolves from 30 to 80 degrees. It is then clear that this fifth impeller 1*f* has blades 3 less twisted than the blades 3 of the fourth impeller 1*e*, the consequence of which is that the blade root ends 4 of the fifth impeller 1*f* are more loaded than the blade root ends 4 of the fourth impeller 1*e*.

The dimensions of the chords are also different between the fourth and fifth impellers 1*e*, 1*f*. In accordance with this example as shown the chord C4 of the blade root end 4 is equal to 3 centimeters to within the manufacturing tolerances and the chord C6 of the blade tip end 5 is equal to twelve centimeters to within the manufacturing tolerances. Thus the chords C4, C6 of the ends 4, 5 of the blades 3 of the fifth impeller 1*f* are longer than the chords C1, C3 of the ends 4, 5 of the blades 3 of the fourth impeller 1*e*.

For a better comparison of these two impellers 1*e*, 1*f*, the graphs in FIGS. 11A to 11E represent the characteristics of the fourth impeller 1*e* while the graphs in FIGS. 12A to 12E represent the characteristics of the fifth impeller 1*f*. These figures illustrate the evolution of certain geometrical characteristics of the impeller 1*e*, 1*f* as a function of the radius RA of the impeller 1*e*, if expressed in meters.

Figure 11A:
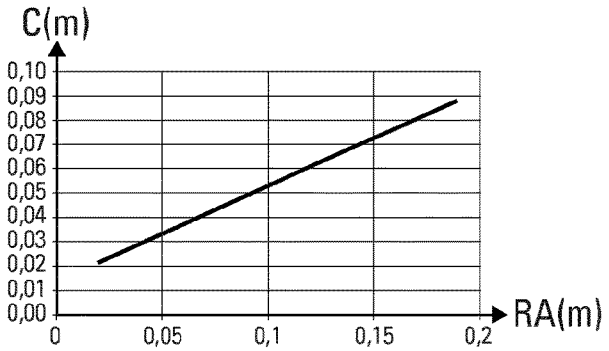
FIGS. 11A to 11E are graphs showing the evolution of certain geometrical characteristics of the fourth impeller as a function of the evolution of the radius of the impeller.
Figure 12A:
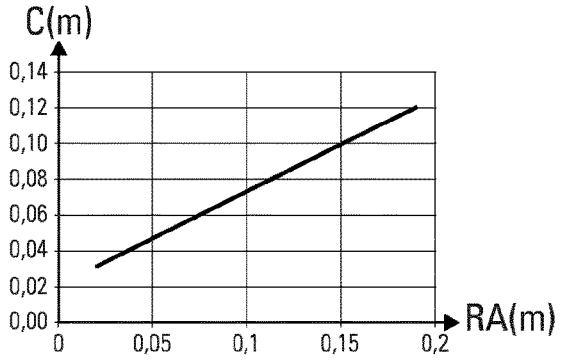
FIGS. 12A to 12E are graphs showing the evolution of certain geometrical characteristics of the fifth impeller as a function of the evolution of the radius of the impeller.

FIGS. 11A and 12A show that for a given blade 3, whether of the fourth or fifth impeller 1*e*, 1*f*, the chord C expressed in meters increases regularly from the blade root end 4 to the blade tip end 5. Thus in each section of the blade 3 from the blade root end 4 to the blade tip end 5 the chord C increases in a uniform and regular manner.

Figure 11B:
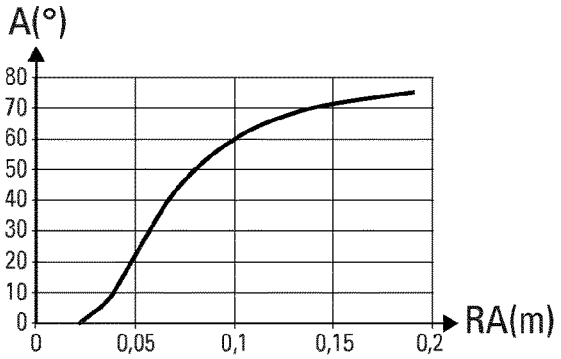
Figure 12B:
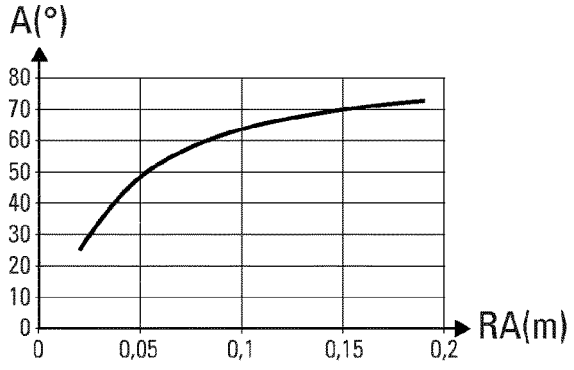

FIGS. 11B and 12B represent the evolution of the pitch angle A expressed in degrees over the fourth impeller 1*e* or over the fifth impeller 1*f* as a function of the radius RA of the given impeller 1*e*, 1*f*. In both cases it is seen that the pitch angle A increases on approaching the blade tip end 5 until a limit value between 70 and 80 degrees inclusive is reached. These graphs confirm that the twist of the fourth or fifth impeller 1*e*, 1*f* opens on approaching the blade tip end 5.

Figure 11C:
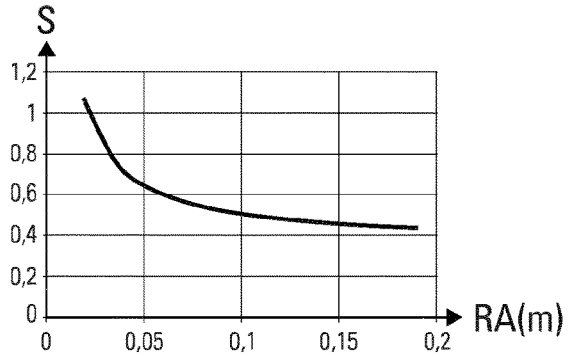
Figure 12C:
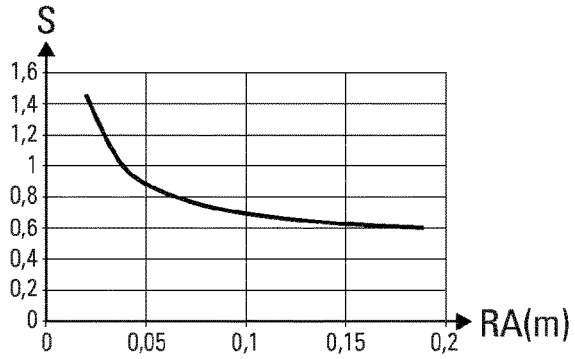

FIGS. 11C and 12C represent the evolution of the shrinkage allowance S, no units, of the fourth impeller 1*e* or of the fifth impeller 1*f* as a function of the radius RA of the given impeller 1*e*, 1*f*. The shrinkage allowance S is defined for a given section of blade 3 as being the ratio between the chord C and the distance D between two identical points on two adjacent blades 3. It is then seen that for both impellers 1*e*, if the shrinkage allowance S decreases on approaching the blade tip end 5 until a limit value between 0.4 and 0.6 inclusive is reached for the fourth impeller 1*e* and between 0.6 and 0.8 inclusive is reached for the fifth impeller 1*f*.

Figure 11D:
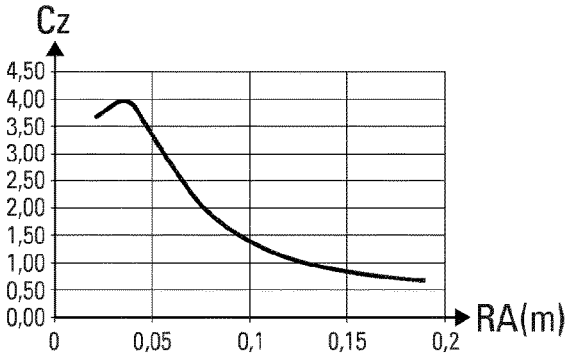
Figure 12D:
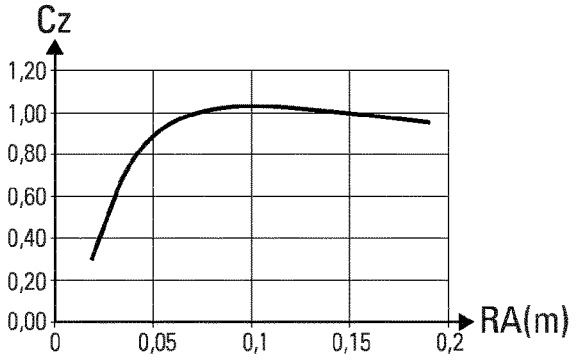

FIGS. 11D and 12D represent the evolution of the lift coefficient CZ, no units, of the fourth impeller 1*e* or of the fifth impeller 1*f* along the radius RA of the given impeller 1*e*, 1*f*. The lift coefficient CZ represents the lift that is exerted perpendicularly to the blade 3. It is then seen that for the fourth impeller 1*e* the lift coefficient CZ decreases on approaching the blade tip end 5 until a limit value between 0.5 and 1 is reached whereas for the fifth impeller 1*f* the lift coefficient CZ increases until a maximum value between 0.8 and 1 inclusive is reached on approaching the blade tip end 5.

Figure 11E:
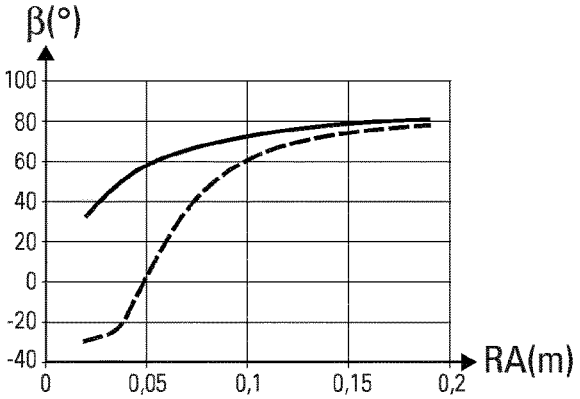
Figure 12E:
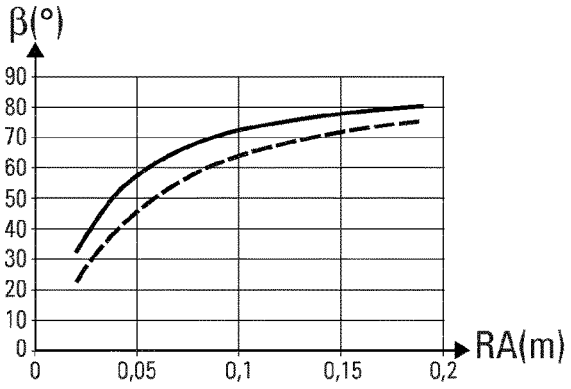

FIGS. 11E and 12E represent the evolution of the flow angles β expressed in degrees at the leading edge 6 (in continuous line) and at the trailing edge 7 (dashed line) for a blade 3 of the fourth impeller 1*e* or of the fifth impeller 1*f* along the radius RA of the given impeller 1*e*, 1*f*, it is then seen that for the fourth impeller 1*e*, more twisted than the fifth impeller 1*f*, the difference between the flow angle β of the leading edge 6 and the flow angle β of the trailing edge 7 is greater at the level of the blade root end 4 than at the blade tip end 5. For the fifth impeller 1*f* the difference between the flow angle β of the leading edge 6 and the flow angle β of the trailing edge 7 remains homogeneous all along the blade 3.

There will be now be described with the aid of FIGS. 13A to 16B the application of an impeller 1*d*, 1*e*, 1*f* conforming to the invention in a motor-fan unit 10. It must be remembered that the motor-fan unit 10 makes it possible to optimize the agitation of a flow of air in the direction of a heat exchanger intended to regulate the temperature of an engine. According to the invention the fourth impeller 1*e*, just like the fifth impeller 1*f*, is particularly suitable for mounting in a motor-fan unit 10 of this kind but the following embodiments integrate the fifth impeller 1*d* and variants of that fifth impeller 1*d*.

In a manner common to FIGS. 13A to 16B the motor-fan unit 10 comprises a support 11 on which is mounted a fan 12, with the fan 12 including the impeller 1*d*, 1*e*, 1*f* and a device 13 for driving the impeller 1*d*, 1*e*, 1*f* in rotation. To be more precise the support 11 comprises an opening 31 in which the impeller 1*d*, 1*e*, 1*f* is situated. FIGS. 13A to 16B show five possible types of drive device 13 for driving an impeller 1*d*, 1*e*, 1*f* of this kind having a central hub 20 the diameter D20 of which is less than or equal to 15% of the diameter D2 of the cylindrical ring 2 and the possible configurations that the impeller 1*d*, 1*e*, 1*f* may assume in order to cooperate with those drive devices 13.

FIGS. 13A and 13B show a first embodiment of the motor-fan unit 10 in which the drive device 13 comprises electromagnetic or magnetic devices of the coil 14 or magnet type. To be more precise, in accordance with this embodiment the drive device 13 comprises 24 coils 14 distributed uniformly with respect to one another around the rotation axis RO of the impeller 1*d*, 1*e*, 1*f*. In accordance with a variant embodiment the drive device 13 comprises four coils 14 disposed at 90 degrees to one another around the rotation axis RO of the impeller 1*d*, 1*e*, 1*f*. For its part, the impeller 1*d*, 1*e*, 1*f* also comprises electromagnetic or magnetic elements 15 having properties enabling cooperation with the magnetism induced by the coils 14 of the drive device 13 in order for the magnetic field to drive the impeller 1*d*, 1*e*, 1*f* in rotation. As FIGS. 13A and 13B show the electromagnetic elements 15 of the impeller 1*d*, 1*e*, 1*f* are magnets and are preferably situated on the cylindrical ring 2 of the impeller 1*d*, 1*e*, 1*f*.

In FIG. 13A the central hub 20 cooperates with the pin 21 which in the context of this embodiment is stationary and secured to an arm 30 participating in centering the impeller 1*d*, 1*e*, 1*f* in the opening 31 in the support 11. In fact in accordance with the embodiment shown in FIGS. 13A and 14 to 16B six arms 31 extend from the support 11 in the direction of the central hub 20. The impeller 1*d*, 1*e*, 1*f* driven in rotation by the induced magnetic field turns about the stationary pin 21.

The variant embodiment shown in FIG. 13B includes a support 11 with no arm 30. The impeller 1*d*, 1*e*, 1*f* is then supported only by its cylindrical ring 2 in the support 11 and the central hub 20 serves only to fasten the blades 3 to one another. In this case the central hub is preferably hollow in order to enable a passage of air through the central hub 20 and more particularly through its free central zone. It is then referred to as an annular central hub 20 and has a diameter D20 less than or equal to 15% of the diameter D2 of the cylindrical ring 2.

The embodiments shown in FIGS. 14 to 16B differ from the embodiments shown in FIGS. 13A and 13B in the sense that the impeller 1*d*, 1*e*, 1*f* is driven by a drive device of mechanical and not magnetic or electromagnetic type.

Figure 14:
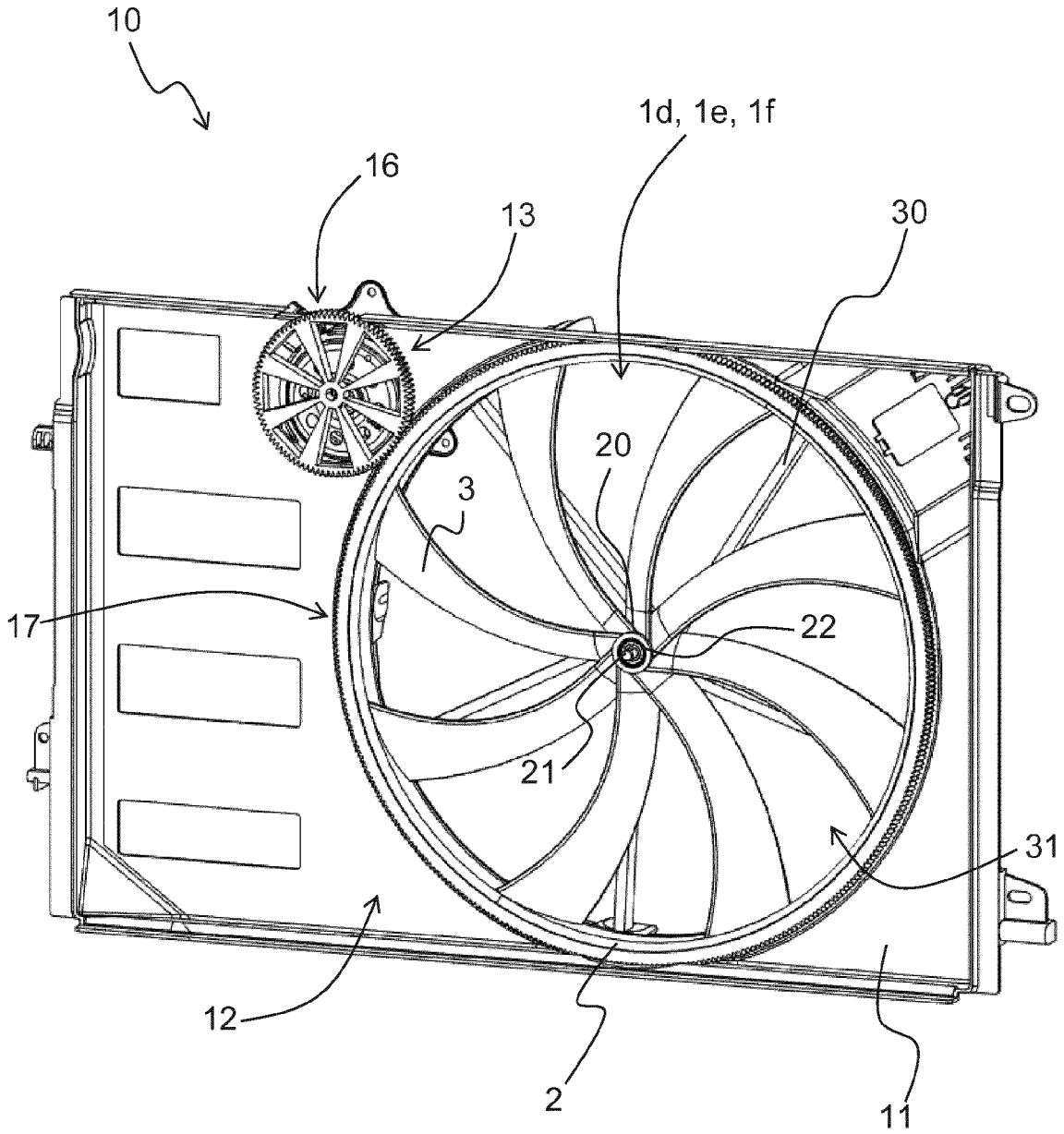
FIG. 14 is a perspective view showing a second embodiment of the motor-fan unit equipped with an impeller conforming to the second embodiment of the present invention and in which a device for driving the impeller includes gears.

FIG. 14 shows a second embodiment of the motor-fan unit 10 in which the drive device 13 comprises gears 16. To be more precise, in accordance with this embodiment motorized gears 16 are situated on a front face of the support 11 and cooperate with an electric motor (not shown) situated on a rear face of the support 11 from which the arms 30 extend, the front face and the rear face being two faces of the support 11 parallel to and opposite one another along the rotation axis RO of the impeller 1*d*, 1*e*, 1*f*. The motorized gears 16 and the motor are disposed at the periphery of the impeller 1*d*, 1*e*, 1*f*. By this is meant that this drive device 13 does not take up any space on the available area of the impeller 1*d*, 1*e*, 1*f*.

In order for the impeller 1*d*, 1*e*, 1*f* to be driven in rotation by these motorized gears 16 it includes teeth 17. To be more precise, it is the cylindrical ring 2 that comprises the teeth 17 to cooperate with the gears 16. The teeth 17 may consist of an attached part taking the form of a cylindrical rim that is clipped onto the cylindrical ring 2 of the impeller 1*d*, 1*e*, 1*f*. In accordance with a variant embodiment the teeth 17 and the cylindrical ring 2 are formed in one piece.

In the same manner as previously, the central hub 20 cooperates with the pin 21, which in the context of this embodiment is stationary and secured to the arms 30 participating in centering the impeller 1*d*, 1*e*, 1*f* in the opening 31 of the support 11.

Figure 15:
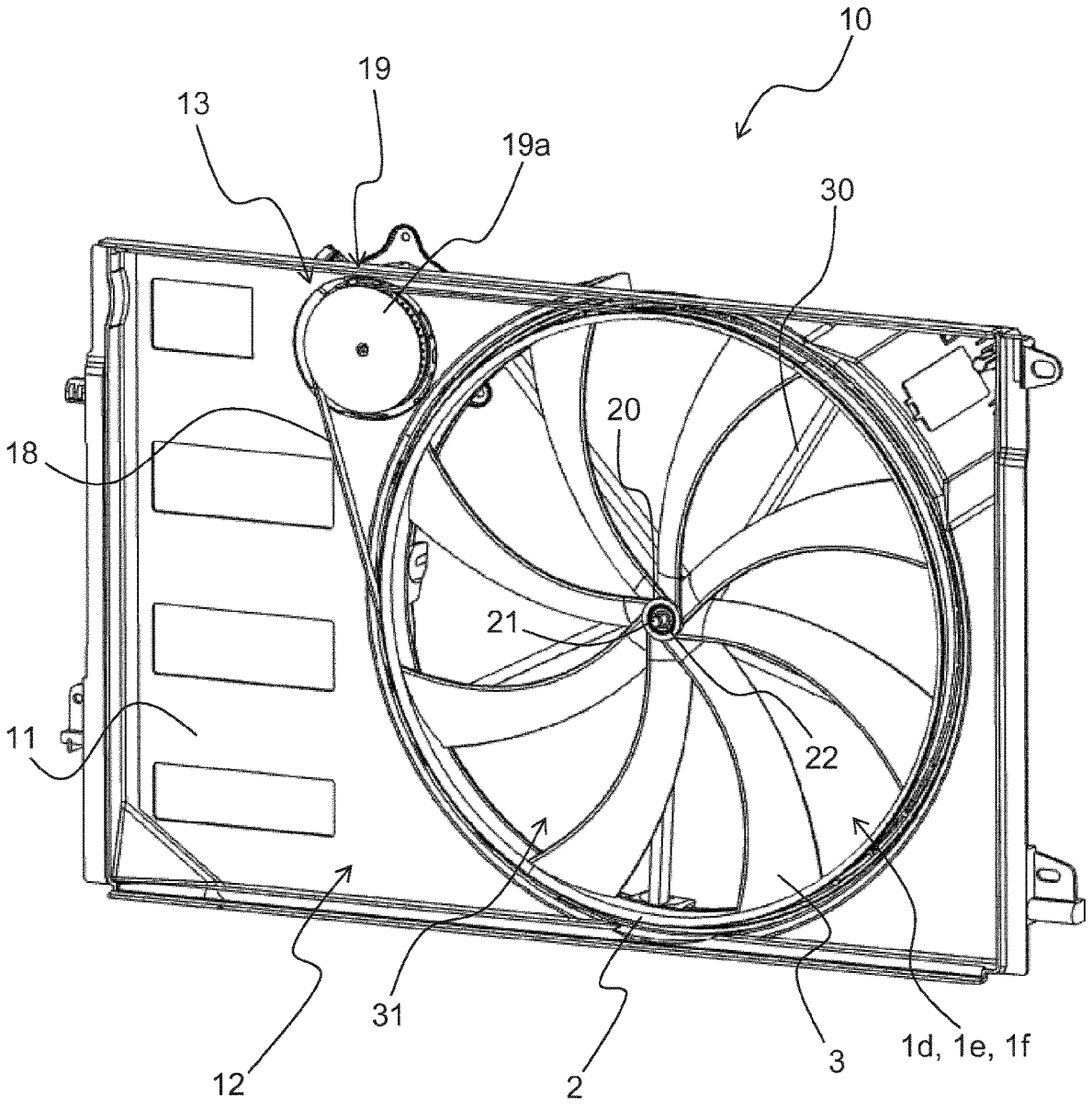
FIG. 15 is a perspective view showing a third embodiment of the motor-fan unit equipped with an impeller conforming to the second embodiment of the present invention and in which a device for driving the impeller includes a belt cooperating with the cylindrical ring of the impeller.

FIG. 15 shows a third embodiment of the motor-fan unit 10 in which the drive device 13 comprises a belt 18 for driving the impeller 1*d*, 1*e*, 1*f* and a mechanism 19 for driving the belt 18. To be more precise, the mechanism 19 comprises a drive pulley 19*a* on which the belt 18 is intended to be driven and an electric motor (not visible) driving the drive pulley 19*a* in rotation. In accordance with this embodiment the drive pulley 19*a* of the mechanism 19 is situated on the front face of the support 11 and cooperates with the electric motor situated on the rear face of the support 11. The belt 18 cooperates with the cylindrical ring 2 of the impeller 1*d*, 1*e*, 1*f* in order to drive it in rotation. To this end the impeller 1*d*, 1*e*, 1*f*, to be more precise the cylindrical ring 2, is configured to receive the belt 18. In the embodiment shown the cylindrical ring 2 of the impeller 1*d*, 1*e*, 1*f* comprises a shoulder, such as that visible in FIGS. 8A to 8B, for retaining the belt 18 and for preventing disengagement of the belt 18 from the impeller 1*d*, 1*e*, 1*f*. In accordance with a variant embodiment the impeller 1*d*, 1*e*, 1*f* comprises a groove to receive the belt 18 and to retain it in place.

In the same manner as previously, the central hub 20 cooperates with the pin 21 which in the context of this embodiment is stationary and secured to the arms 30 participating in centering the impeller 1*d*, 1*e*, 1*f* in the opening 31 of the support 11.

Figure 16A:
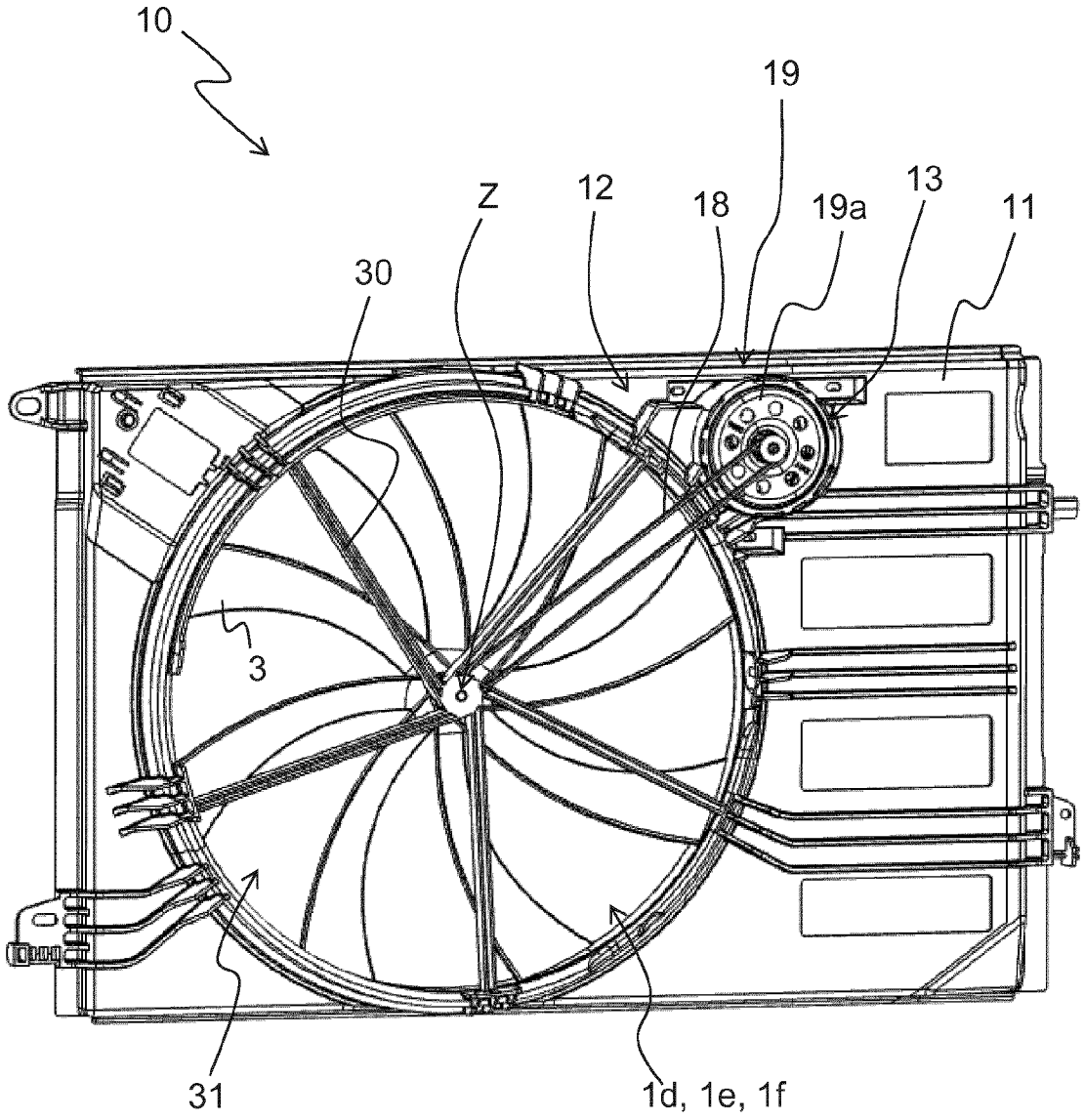
FIG. 16A is a perspective view showing a fourth embodiment of the motor-fan unit equipped with an impeller conforming to the second embodiment of the present invention and in which a device for driving the impeller includes a belt cooperating with the central hub of the impeller.
Figure 16B:
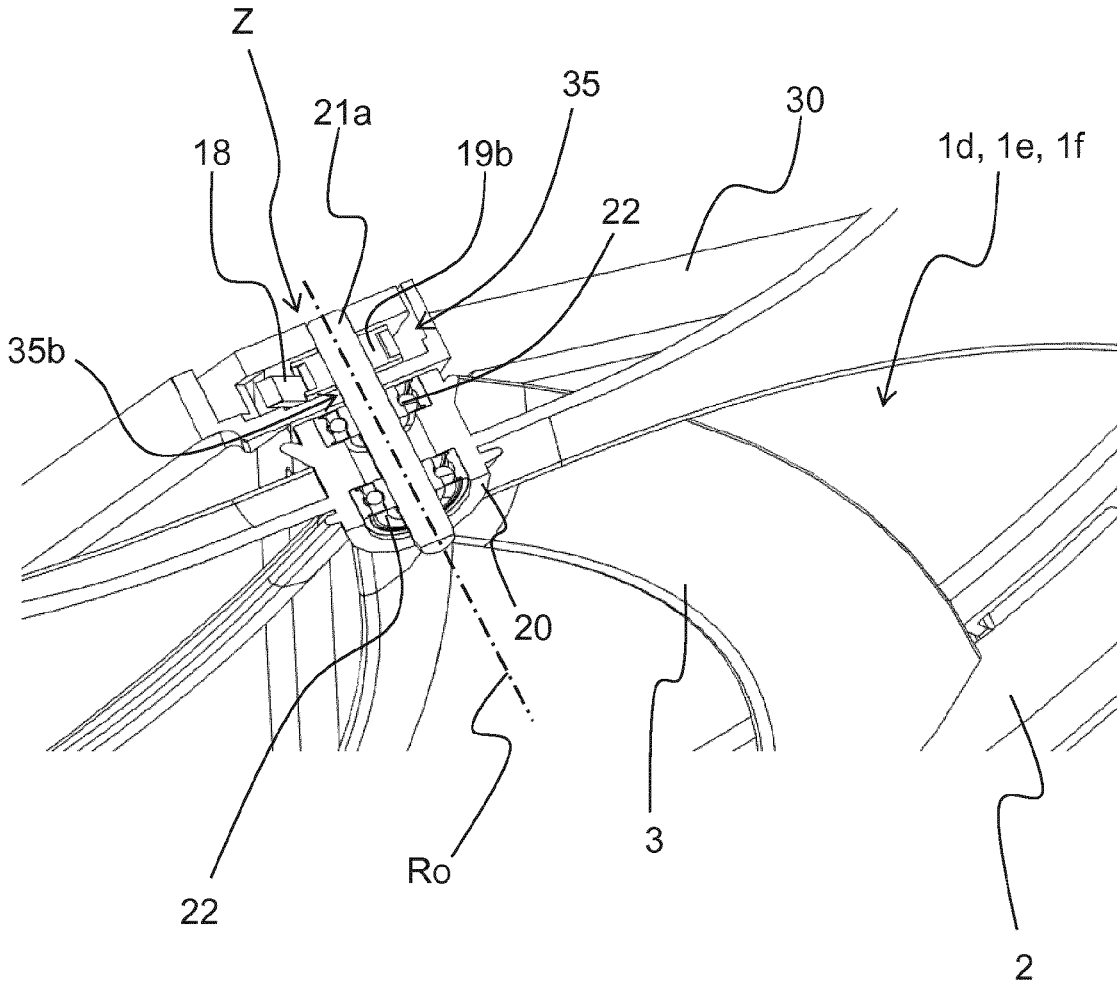
FIG. 16B is a sectional view of the fourth embodiment of the motor-fan unit from FIG. 16A.

FIGS. 16A and 16B show a fourth embodiment of the motor-fan unit 10 in which the drive device 13 comprises a belt 18 for driving the impeller 1*d*, 1*e*, 1*f* and a mechanism 19 for driving the belt 18. To be more precise the mechanism 19 comprises a drive pulley 19*a* on which the belt 18 is intended to be driven and an electric motor (not visible) driving the drive pulley 19*a* in rotation. In accordance with this embodiment the drive pulley 19*a* of the mechanism 19 is situated on the front face of the support 11 and cooperates with the electric motor situated on the rear face of the support 11.

In accordance with this fourth embodiment the belt 18 cooperates with a central gear 19*b* having a rotation axis coinciding with the rotation axis RO of the impeller 1*d*, 1*e*, 1*f*. The central gear 19*b* is situated in a zone Z in which all the arms 30 meet. As FIG. 16B shows this zone Z comprises a housing 35 including at least one first opening so that the belt 18 is able to circulate in the housing 35 in order to drive the central pulley 19*b* in rotation and a second opening 35*b* through which passes a shaft 21*a*.

The particular feature of this fourth embodiment lies in the fact that the pin 21 is replaced by a shaft 21*a* mobile in rotation. To be more precise the shaft 21*a* is constrained to rotate with the central pulley 19*b*. When the central pulley 19*b* turns the shaft 21*a* therefore also turns. In order to drive the impeller 1*d*, 1*e*, 1*f* in rotation the shaft 21*a* is also constrained to rotate with the impeller 1*d*, 1*e*, 1*f*. To this end the rotation bearings 22 are a tight fit. Thus when the central pulley 19*b* turns the impeller 1*d*, 1*e*, 1*f* also turns. In accordance with a variant embodiment, the rotation bearings 22 are absent and the shaft 21*a* is in contact with the impeller 1*d*, 1*e*, 1*f* in order to drive it in rotation.

Thus, in contrast with the previous embodiments, the central hub 20 cooperates with a shaft 21*a*, that is mobile in rotation. Moreover, it is also to be noted that this embodiment differs from the others in that the central gear 19*b* driving the impeller 1*d*, 1*e*, 1*f* in rotation is situated on the rear face of the support 11 from which the arms 30 extend.

In all the embodiments of the motor-fan unit 10 that have just been described the drive device 13 is situated at the periphery of the impeller 1*d*, 1*e*, 1*f* on the support 11 and cooperates with the cylindrical ring 2 of the impeller 1*d*, 1*e*, 1*f* or with its central hub 20. In all cases the drive device 13 is situated outside the opening 31 in which the impeller 1*d*, 1*e*, 1*f* is situated. It is therefore certain that the drive device 13 generates no dead zone in front of the impeller 1*d*, 1*e*, 1*f*.

The invention as just described should not be seen as limited to the means and configurations exclusively described and shown and applies equally to any equivalent means or configurations and any combination of such means or configurations. Likewise, although the invention has been described here in accordance with embodiments each employing separately a type of configuration or arrangement of the blades of the impeller or of the rotation drive device, it goes without saying that the various arrangements shown may be combined without this compromising the invention.

The invention claimed is:

1. An impeller of a motor vehicle fan comprising:

a cylindrical ring having a center; and blades extending from the cylindrical ring and toward the center, each blade having two radially opposite ends, a blade root end and a blade tip end, the blade root end being directed toward the center and the blade tip end being secured to the cylindrical ring, wherein every blade root end is a free end such that the blades are entirely supported by the cylindrical ring, and wherein the cylindrical ring is directly driven by a rotation device.

2. The impeller as claimed in claim 1, further comprising a free central zone formed by the blade root end of the blades, the free central zone forming an imaginary circle having a diameter less than or equal to 15% of a diameter of the impeller.

3. The impeller as claimed in claim 1, wherein each blade has a chord increasing regularly from the blade root end to the blade tip end.

4. The impeller as claimed in claim 1, wherein the blade root end has a non-zero chord.

5. The impeller as claimed in claim 1, wherein the cylindrical ring has a width measured along a rotation axis of the impeller such that the blades are entirely contained within a volume delimited by the cylindrical ring.

6. The impeller as claimed in claim 1, wherein the blades have a twisted profile from the blade tip end to the blade root end, a twist of the twisted profile being defined about a torsion axis.

7. The impeller as claimed in claim 6, wherein the torsion axis about which the blades have the twisted profile coincides with a radius of the impeller.

8. The impeller as claimed in claim 1, wherein, along a blade, a ratio, referred to as a shrinkage allowance, between a chord of the blade and a distance separating a same point on two adjacent blades decreases toward the blade root end.

9. A motor vehicle motor-fan unit comprising:

a support on which is mounted a fan, the fan comprising:

an impeller, and a rotation drive device for driving the impeller in rotation, wherein the impeller is as defined in claim 1.

10. The motor vehicle motor-fan unit as claimed in claim 9, wherein the rotation drive device is situated at a periphery of the impeller, on the support, and cooperates with a cylindrical ring of the impeller.

11. The motor vehicle motor-fan unit as claimed in claim 9, wherein the rotation drive device is situated at a periphery of the impeller, on the support, and cooperates with a central hub of the impeller.

12. An impeller of a motor vehicle fan, comprising:

a cylindrical ring having a diameter;

a central hub inscribed in the cylindrical ring having a diameter less than the diameter of the cylindrical ring, the central hub and the cylindrical ring being concentric; and blades extending between the cylindrical ring and the central hub, wherein the diameter of the central hub is less than or equal to 15% of the diameter of the cylindrical ring.

13. The impeller as claimed in claim 12, wherein the diameter of the cylindrical ring is less than or equal to 43 centimeters.

14. The impeller as claimed in claim 12, wherein the diameter of the central hub is between 3 and 4 centimeters inclusive.

15. The impeller as claimed in claim 12, wherein the central hub is intended to receive a pin about which the impeller is free to rotate.

16. The impeller as claimed in claim 12, wherein the central hub is intended to be constrained to rotate with a shaft configured to participate in driving the impeller in rotation.

17. The impeller as claimed in claim 12, wherein the cylindrical ring has a width, measured along a rotation axis of the impeller, such that the blades are entirely contained within a volume delimited by the cylindrical ring.

18. The impeller as claimed in claim 12, wherein the blades have a twisted profile from a blade tip end to a blade root end, a twist of the twisted profile being defined about a torsion axis.

19. The impeller as claimed in claim 12, wherein, along a blade, a ratio, referred to as a shrinkage allowance, between a chord of the blade and a distance separating a same point on two adjacent blades decreases toward a blade root end of the blade.

* * * * *